US007286781B2

(12) United States Patent
Koido

(10) Patent No.: US 7,286,781 B2
(45) Date of Patent: Oct. 23, 2007

(54) DEVELOPER, IMAGE FORMING METHOD AND IMAGE FORMING APPARATUS

(75) Inventor: Kenji Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 20 days.

(21) Appl. No.: 11/187,892

(22) Filed: Jul. 25, 2005

(65) Prior Publication Data

US 2006/0024605 A1 Feb. 2, 2006

(30) Foreign Application Priority Data

Jul. 30, 2004 (JP) ..... 2004-222974

(51) Int. Cl.
*G03G 15/20* (2006.01)

(52) U.S. Cl. ..... 399/67; 399/68; 399/320; 399/324; 430/108.8; 430/124

(58) Field of Classification Search ..... 399/68, 399/67, 320, 324; 430/120, 108.8, 124
See application file for complete search history.

(56) References Cited

U.S. PATENT DOCUMENTS 4,882,258 A * 11/1989 Ikeuchi et al. ..... 430/108.21
4,921,771 A * 5/1990 Tomono et al. ..... 430/108.8
5,547,799 A * 8/1996 Yoshie et al. ..... 430/108.2
6,057,076 A * 5/2000 Berkes et al. ..... 430/137.18
6,120,961 A * 9/2000 Tanikawa et al. ..... 430/108.8
6,156,470 A * 12/2000 Matsunaga et al. ..... 430/108.3
6,296,980 B1 * 10/2001 Oshiba et al. ..... 430/110.3
6,346,356 B1 * 2/2002 Ohno et al. ..... 430/108.2
6,447,970 B1 * 9/2002 Matsunaga et al. ..... 430/108.3
6,458,499 B1 * 10/2002 Onuma et al. ..... 430/108.4
6,589,701 B2 * 7/2003 Yamazaki et al. ..... 430/106.2
6,602,644 B2 * 8/2003 Matsushima et al. .... 430/108.4
6,670,087 B2 * 12/2003 Fujikawa et al. ..... 430/109.2
6,783,909 B2 * 8/2004 Kawanishi et al. ..... 430/108.8
6,924,073 B2 * 8/2005 Higuchi et al. ..... 430/108.4
7,022,448 B2 * 4/2006 Yaguchi et al. ..... 430/108.8
7,138,213 B2 * 11/2006 Itakura et al. ..... 430/45
2004/0131962 A1 * 7/2004 Nakamura et al. ..... 430/108.21
2006/0057482 A1 * 3/2006 Yuasa ..... 430/108.2

FOREIGN PATENT DOCUMENTS

JP 2003-091094 3/2003

* cited by examiner

*Primary Examiner*—Hoa Van Le
(74) *Attorney, Agent, or Firm*—Rabin & Berdo, PC

(57) ABSTRACT

A toner for developing a latent image includes, at least, a binder resin, a releasing agent, a coloring agent and a fluidizing agent. A melting point Tw of the releasing agent is higher than or equals to a softening temperature Ts of the developer measured by a capillary rheometer of a constant shear stress type. The melting point Tw of the releasing agent is lower than or equals to a melting temperature Tm of the developer measured by ½ method. Using the above described toner, it becomes possible to print a full color image at a high speed without causing an offset phenomena or sheet jam.

12 Claims, 12 Drawing Sheets

COMBINATION OF RELEASING AGENTS

| | TONER (No.) | RELEASING AGENT A | RELEASING AGENT A Tw (°C) | RELEASING AGENT B | RELEASING AGENT B Tw (°C) | THERMAL PROPERTY OF TONER | | |
|---|---|---|---|---|---|---|---|---|
| | | | | | | Ts (°C) | Tf (°C) | Tm (°C) |
| COMPARATIVE EXAMPLE 14 | 33 | WAX 10 | 130 | WAX 3 | 120 | 73.9 | 92.9 | 104.4 |
| COMPARATIVE EXAMPLE 15 | 34 | WAX 3 | 120 | WAX 5 | 94 | 72.4 | 91.9 | 104.7 |
| COMPARATIVE EXAMPLE 16 | 35 | WAX 2 | 110 | WAX 8 | 83 | 72.2 | 90.3 | 103.5 |
| COMPARATIVE EXAMPLE 17 | 36 | WAX 2 | 110 | WAX 6 | 65 | 71.9 | 90.7 | 102.2 |
| COMPARATIVE EXAMPLE 18 | 37 | WAX 1 | 100 | WAX 5 | 94 | 72.3 | 91.7 | 102.3 |
| EXAMPLE 18 | 31 | WAX 1 | 100 | WAX 8 | 83 | 72.2 | 90.5 | 103.5 |
| EXAMPLE 19 | 32 | WAX 5 | 94 | WAX 4 | 89 | 71.1 | 90.4 | 102.9 |
| COMPARATIVE EXAMPLE 19 | 38 | WAX 5 | 94 | WAX 6 | 65 | 71.8 | 90.4 | 101.8 |
| COMPARATIVE EXAMPLE 20 | 39 | WAX 8 | 83 | WAX 7 | 75 | 71.0 | 90.6 | 102.3 |
| COMPARATIVE EXAMPLE 21 | 40 | WAX 7 | 75 | WAX 6 | 65 | 70.3 | 90.1 | 102.4 |

FIG.6

NUMBER-AVERAGE MOLECULAR WEIGHT Mn OF BINDER=3700, ADDING AMOUNT OF RELEASING AGENT =10.0 WEIGHT PARTS

| | TONER (NO.) | RELEASING AGENT | MATERIAL OF RELEASING AGENT | THERMAL PROPERTY OF RELEASING AGENT Tw (°C) | THERMAL PROPERTY OF TONER | | | SHEET FEEDING SPEED OF IMAGE FORMING APPARATUS | | | | | |
|---|---|---|---|---|---|---|---|---|---|---|---|---|---|
| | | | | | | | | 100mm/s | | 150mm/s | | 300mm/s | |
| | | | | | Ts (°C) | Tf (°C) | Tm (°C) | TEMPERATURE RANGE (°c) | FIXING MARGIN (°C) | TEMPERATURE RANGE (°c) | FIXING MARGIN (°C) | TEMPERATURE RANGE (°c) | FIXING MARGIN (°C) |
| COMPARATIVE EXAMPLE 1 | 6 | WAX 6 | ESTER | 65 | 86.3 | 94.4 | 123.4 | 125-145 | 20 | NONE | 0 | NONE | 0 |
| COMPARATIVE EXAMPLE 2 | 7 | WAX 7 | ESTER | 75 | 87.0 | 95.0 | 124.2 | 125-145 | 20 | NONE | 0 | NONE | 0 |
| COMPARATIVE EXAMPLE 3 | 8 | WAX 8 | ESTER | 83 | 88.0 | 94.3 | 125.4 | 125-145 | 20 | NONE | 0 | NONE | 0 |
| COMPARATIVE EXAMPLE 4 | 9 | WAX 9 | POLY-ETHYLENE | 85 | 88.2 | 93.8 | 125.5 | 125-145 | 20 | NONE | 0 | NONE | 0 |
| EXAMPLE 4 | 4 | WAX 4 | POLY-ETHYLENE | 89 | 88.1 | 94.9 | 124.6 | 130-160 | 30 | 145-160 | 15 | 150-160 | 10 |
| EXAMPLE 5 | 5 | WAX 5 | POLY-ETHYLENE | 94 | 88.5 | 95.1 | 125.0 | 135-165 | 30 | 150-165 | 15 | 155-165 | 10 |
| EXAMPLE 1 | 1 | WAX 1 | POLY-ETHYLENE | 100 | 88.6 | 95.2 | 125.1 | 140-180 | 40 | 155-190 | 35 | 160-190 | 30 |
| EXAMPLE 2 | 2 | WAX 2 | POLY-PROPYLENE | 110 | 89.1 | 94.6 | 126.0 | 145-185 | 40 | 160-195 | 35 | 165-195 | 30 |
| EXAMPLE 3 | 3 | WAX 3 | POLY-PROPYLENE | 120 | 88.8 | 95.0 | 126.3 | 150-190 | 40 | 165-200 | 35 | 170-200 | 30 |
| COMPARATIVE EXAMPLE 5 | 10 | WAX 10 | POLY-PROPYLENE | 130 | 89.0 | 94.3 | 126.0 | 170-190 | 20 | NONE | 0 | NONE | 0 |

"TEMPERATURE RANGE" : FAVORABLE FIXING TEMPERATURE RANGE

FIG.7

NUMBER-AVERAGE MOLECULAR WEIGHT Mn OF BINDER=2800, ADDING AMOUNT OF RELEASING AGENT =10.0 WEIGHT PARTS

| | TONER (NO.) | RELEASING AGENT | MATERIAL OF RELEASING AGENT | THERMAL PROPERTY OF RELEASING AGENT | THERMAL PROPERTY OF TONER | | | SHEET FEEDING SPEED OF IMAGE FORMING APPARATUS | | | | | |
|---|---|---|---|---|---|---|---|---|---|---|---|---|---|
| | | | | | | | | 100mm/s | | 150mm/s | | 300mm/s | |
| | | | | TW (°C) | Ts | Tf (°C) | Tm (°C) | TEMPERATURE RANGE (°c) | FIXING MARGIN (°C) | TEMPERATURE RANGE (°c) | FIXING MARGIN (°C) | TEMPERATURE RANGE (°c) | FIXING MARGIN (°C) |
| COMPARATIVE EXAMPLE 6 | 16 | WAX 6 | ESTER | 65 | 72.2 | 90.1 | 100.9 | 120-140 | 20 | NONE | 0 | NONE | 0 |
| EXAMPLE 8 | 17 | WAX 7 | ESTER | 75 | 70.7 | 90.9 | 101.1 | 125-155 | 30 | 140-155 | 15 | 145-155 | 10 |
| EXAMPLE 9 | 18 | WAX 8 | ESTER | 83 | 71.1 | 90.8 | 101.9 | 130-160 | 30 | 145-160 | 15 | 150-160 | 10 |
| EXAMPLE 10 | 19 | WAX 9 | POLY-ETHYLENE | 85 | 72.5 | 90.8 | 103.1 | 130-160 | 30 | 145-160 | 15 | 150-160 | 10 |
| EXAMPLE 11 | 14 | WAX 4 | POLY-ETHYLENE | 89 | 72.4 | 90.6 | 102.1 | 135-165 | 30 | 150-165 | 15 | 155-165 | 10 |
| EXAMPLE 6 | 15 | WAX 5 | POLY-ETHYLENE | 94 | 72.4 | 90.8 | 102.2 | 140-180 | 40 | 155-190 | 35 | 160-190 | 30 |
| EXAMPLE 7 | 11 | WAX 1 | POLY-ETHYLENE | 100 | 71.9 | 90.9 | 102.4 | 145-185 | 40 | 160-195 | 35 | 165-195 | 30 |
| COMPARATIVE EXAMPLE 7 | 12 | WAX 2 | POLY-PROPYLENE | 110 | 71.8 | 90.1 | 102.8 | 160-180 | 20 | NONE | 0 | NONE | 0 |
| COMPARATIVE EXAMPLE 8 | 13 | WAX 3 | POLY-PROPYLENE | 120 | 72.0 | 90.3 | 103.0 | 165-185 | 20 | NONE | 0 | NONE | 0 |
| COMPARATIVE EXAMPLE 9 | 20 | WAX 10 | POLY-PROPYLENE | 130 | 73.3 | 91.0 | 102.9 | 170-190 | 20 | NONE | 0 | NONE | 0 |

"TEMPERATURE RANGE" : FAVORABLE FIXING TEMPERATURE RANGE

FIG.8

NUMBER-AVERAGE MOLECULAR WEIGHT Mn OF BINDER=2800, ADDING AMOUNT OF RELEASING AGENT =3.0 WEIGHT PARTS

| | TONER (NO.) | RELEASING AGENT | MATERIAL OF RELEASING AGENT | THERMAL PROPERTY OF RELEASING AGENT | THERMAL PROPERTY OF TONER | | | SHEET FEEDING SPEED OF IMAGE FORMING APPARATUS | | | | | |
|---|---|---|---|---|---|---|---|---|---|---|---|---|---|
| | | | | | | | | 100mm/s | | 200mm/s | | 300mm/s | |
| | | | | Tw (°C) | Ts (°C) | Tf (°C) | Tm (°C) | TEMPERATURE RANGE (°c) | FIXING MARGIN (°C) | TEMPERATURE RANGE (°c) | FIXING MARGIN (°C) | TEMPERATURE RANGE (°c) | FIXING MARGIN (°C) |
| COMPARATIVE EXAMPLE 10 | 26 | WAX 6 | ESTER | 65 | 72.4 | 91.9 | 103.3 | 120-130 | 10 | NONE | 0 | NONE | 0 |
| EXAMPLE 14 | 27 | WAX 7 | ESTER | 75 | 72.0 | 92.3 | 102.4 | 125-140 | 15 | 135-140 | 10 | 140-145 | 5 |
| EXAMPLE 15 | 28 | WAX 8 | ESTER | 83 | 72.0 | 91.8 | 103.0 | 130-145 | 15 | 150-160 | 10 | 155-160 | 5 |
| EXAMPLE 16 | 29 | WAX 9 | POLY-ETHYLENE | 85 | 73.9 | 92.2 | 103.1 | 135-150 | 15 | 150-160 | 10 | 155-160 | 5 |
| EXAMPLE 17 | 24 | WAX 4 | POLY-ETHYLENE | 89 | 73.0 | 93.0 | 103.0 | 140-155 | 15 | 155-165 | 10 | 160-165 | 5 |
| EXAMPLE 12 | 25 | WAX 5 | POLY-ETHYLENE | 94 | 74.0 | 93.2 | 103.9 | 150-170 | 20 | 155-175 | 20 | 160-175 | 15 |
| EXAMPLE 13 | 21 | WAX 1 | POLY-ETHYLENE | 100 | 73.3 | 93.4 | 104.0 | 155-175 | 20 | 160-180 | 20 | 165-180 | 15 |
| COMPARATIVE EXAMPLE 11 | 22 | WAX 2 | POLY-PROPYLENE | 110 | 72.9 | 94.0 | 103.5 | 165-175 | 10 | NONE | 0 | NONE | 0 |
| COMPARATIVE EXAMPLE 12 | 23 | WAX 3 | POLY-PROPYLENE | 120 | 73.0 | 92.9 | 104.2 | 170-180 | 10 | NONE | 0 | NONE | 0 |
| COMPARATIVE EXAMPLE 13 | 30 | WAX 10 | POLY-PROPYLENE | 130 | 74.3 | 94.0 | 104.1 | 175-185 | 10 | NONE | 0 | NONE | 0 |

"TEMPERATURE RANGE" : FAVORABLE FIXING TEMPERATURE RANGE

FIG.9

COMBINATION OF RELEASING AGENTS

| | TONER (No.) | RELEASING AGENT A | RELEASING AGENT A Tw (°C) | RELEASING AGENT B | RELEASING AGENT B Tw (°C) | THERMAL PROPERTY OF TONER | | |
|---|---|---|---|---|---|---|---|---|
| | | | | | | Ts (°C) | Tf (°C) | Tm (°C) |
| COMPARATIVE EXAMPLE 14 | 33 | WAX 10 | 130 | WAX 3 | 120 | 73.9 | 92.9 | 104.4 |
| COMPARATIVE EXAMPLE 15 | 34 | WAX 3 | 120 | WAX 5 | 94 | 72.4 | 91.9 | 104.7 |
| COMPARATIVE EXAMPLE 16 | 35 | WAX 2 | 110 | WAX 8 | 83 | 72.2 | 90.3 | 103.5 |
| COMPARATIVE EXAMPLE 17 | 36 | WAX 2 | 110 | WAX 6 | 65 | 71.9 | 90.7 | 102.2 |
| COMPARATIVE EXAMPLE 18 | 37 | WAX 1 | 100 | WAX 5 | 94 | 72.3 | 91.7 | 102.3 |
| EXAMPLE 18 | 31 | WAX 1 | 100 | WAX 8 | 83 | 72.2 | 90.5 | 103.5 |
| EXAMPLE 19 | 32 | WAX 5 | 94 | WAX 4 | 89 | 71.1 | 90.4 | 102.9 |
| COMPARATIVE EXAMPLE 19 | 38 | WAX 5 | 94 | WAX 6 | 65 | 71.8 | 90.4 | 101.8 |
| COMPARATIVE EXAMPLE 20 | 39 | WAX 8 | 83 | WAX 7 | 75 | 71.0 | 90.6 | 102.3 |
| COMPARATIVE EXAMPLE 21 | 40 | WAX 7 | 75 | WAX 6 | 65 | 70.3 | 90.1 | 102.4 |

FIG.10

FIXING MARGIN

| | TONER (No.) | SHEET FEEDING SPEED OF IMAGE FORMING APPARATUS | | | | | |
|---|---|---|---|---|---|---|---|
| | | 100 mm/s | | 150 mm/s | | 300 mm/s | |
| | | FAVORABLE TEMPERATURE RANGE (°C) | FIXING MARGIN (°C) | FAVORABLE TEMPERATURE RANGE (°C) | FIXING MARGIN (°C) | FAVORABLE TEMPERATURE RANGE (°C) | FIXING MARGIN (°C) |
| COMPARATIVE EXAMPLE 14 | 33 | 165-185 | 20 | NONE | 0 | NONE | 0 |
| COMPARATIVE EXAMPLE 15 | 34 | 150-180 | 30 | 160-185 | 25 | 165-185 | 20 |
| COMPARATIVE EXAMPLE 16 | 35 | 130-160 | 30 | 140-165 | 25 | 145-165 | 20 |
| COMPARATIVE EXAMPLE 17 | 36 | 140-170 | 30 | 150-175 | 25 | 155-175 | 20 |
| COMPARATIVE EXAMPLE 18 | 37 | 145-185 | 40 | 160-185 | 25 | 165-185 | 20 |
| EXAMPLE 18 | 31 | 140-180 | 40 | 155-190 | 35 | 160-190 | 30 |
| EXAMPLE 19 | 32 | 140-180 | 40 | 155-190 | 35 | 160-190 | 30 |
| COMPARATIVE EXAMPLE 19 | 38 | 130-160 | 30 | 145-160 | 15 | 150-160 | 10 |
| COMPARATIVE EXAMPLE 20 | 39 | 125-155 | 30 | NONE | 0 | NONE | 0 |
| COMPARATIVE EXAMPLE 21 | 40 | 125-145 | 20 | NONE | 0 | NONE | 0 |

FIG.11

FAVORABLE PEEL STRENGTH TEMPERATURE
(TEMPERATURE AT WHICH PEEL STRENGTH IS 80% OR MORE)

(UNIT : °C)

| | TONER (No.) | SHEET FEEDING SPEED OF IMAGE FORMING APPARATUS | | |
|---|---|---|---|---|
| | | 100 mm/s | 150 mm/s | 300 mm/s |
| COMPARATIVE EXAMPLE 14 | 33 | 165 | UNMEASURABLE | UNMEASURABLE |
| COMPARATIVE EXAMPLE 15 | 34 | 150 | 170 | 190 |
| COMPARATIVE EXAMPLE 16 | 35 | 130 | 150 | 170 |
| COMPARATIVE EXAMPLE 17 | 36 | 140 | 160 | 180 |
| COMPARATIVE EXAMPLE 18 | 37 | 145 | 170 | 190 |
| EXAMPLE 18 | 31 | 140 | 150 | 160 |
| EXAMPLE 19 | 32 | 140 | 150 | 160 |
| COMPARATIVE EXAMPLE 19 | 38 | 130 | 140 | 150 |
| COMPARATIVE EXAMPLE 20 | 39 | 125 | UNMEASURABLE | UNMEASURABLE |
| COMPARATIVE EXAMPLE 21 | 40 | 125 | UNMEASURABLE | UNMEASURABLE |

FIG.12

COMBINATION OF RELEASING AGENTS

| | TONER (NO.) | RELEASING AGENT A | RELEASING AGENT A Tw (°C) | RELEASING AGENT B | RELEASING AGENT B Tw (°C) | RELEASING AGENT C | RELEASING AGENT C Tw (°C) | THERMAL PROPERTY OF TONER | | |
|---|---|---|---|---|---|---|---|---|---|---|
| | | | | | | | | Ts (°C) | Tf (°C) | Tm (°C) |
| EXAMPLE 22 | 43 | WAX 9 | 85 | WAX 2 | 110 | - | - | 71.3 | 91.2 | 104.1 |
| EXAMPLE 23 | 44 | WAX 4 | 89 | WAX 2 | 110 | - | - | 72.1 | 91.1 | 104.2 |
| EXAMPLE 24 | 45 | WAX 5 | 94 | WAX 3 | 120 | - | - | 71.1 | 92.5 | 102.5 |
| EXAMPLE 25 | 46 | WAX 1 | 100 | WAX 10 | 130 | - | - | 72.5 | 92.7 | 102.2 |
| EXAMPLE 20 | 41 | WAX 1 | 100 | WAX 8 | 83 | WAX 10 | 130 | 73.0 | 92.2 | 103.7 |
| EXAMPLE 21 | 42 | WAX 5 | 94 | WAX 4 | 89 | WAX 3 | 120 | 72.0 | 91.3 | 103.5 |
| COMPARATIVE EXAMPLE 22 | 19 | WAX 9 | 85 | - | - | - | - | 72.5 | 90.8 | 103.1 |
| COMPARATIVE EXAMPLE 23 | 14 | WAX 4 | 89 | - | - | - | - | 72.4 | 90.6 | 102.1 |
| COMPARATIVE EXAMPLE 24 | 15 | WAX 5 | 94 | - | - | - | - | 72.4 | 90.8 | 102.2 |
| COMPARATIVE EXAMPLE 25 | 11 | WAX 1 | 100 | - | - | - | - | 71.9 | 90.9 | 102.4 |
| COMPARATIVE EXAMPLE 26 | 31 | WAX 1 | 100 | WAX 8 | 83 | | | 72.2 | 90.5 | 103.5 |
| COMPARATIVE EXAMPLE 27 | 32 | WAX 5 | 94 | WAX 4 | 89 | | | 71.7 | 90.4 | 102.9 |

FIG.13

FIXING MARGIN AND MOVING CONDITION OF PRINTING SHEET

| | TONER (NO.) | SHEET FEEDING SPEED OF IMAGE FORMING APPARATUS | | | | | | | | |
|---|---|---|---|---|---|---|---|---|---|---|
| | | 100 mm/s | | | 150 mm/s | | | 300 mm/s | | |
| | | FAVORABLE TEMPERATURE RANGE (°C) | FIXING MARGIN (°C) | MOVING CONDITION OF PRINTING SHEET | FAVORABLE TEMPERATURE RANGE (°C) | FIXING MARGIN (°C) | MOVING CONDITION OF PRINTING SHEET | FAVORABLE TEMPERATURE RANGE (°C) | FIXING MARGIN (°C) | MOVING CONDITION OF PRINTING SHEET |
| EXAMPLE 22 | 43 | 130-160 | 30 | △ | 145-155 | 10 | △ | 150-155 | 5 | ○ |
| EXAMPLE 23 | 44 | 135-165 | 30 | △ | 150-160 | 10 | △ | 155-160 | 5 | ○ |
| EXAMPLE 24 | 45 | 140-180 | 40 | △ | 155-185 | 30 | △ | 160-185 | 25 | ○ |
| EXAMPLE 25 | 46 | 145-185 | 40 | △ | 160-190 | 30 | △ | 165-190 | 25 | ○ |
| EXAMPLE 20 | 41 | 140-180 | 40 | ○ | 160-190 | 30 | ○ | 165-190 | 25 | ○ |
| EXAMPLE 21 | 42 | 140-180 | 40 | ○ | 160-190 | 30 | ○ | 165-190 | 25 | ○ |
| COMPARATIVE EXAMPLE 22 | 19 | 130-160 | 30 | × | 145-160 | 15 | × | 150-160 | 10 | × |
| COMPARATIVE EXAMPLE 23 | 14 | 135-165 | 30 | × | 150-165 | 15 | × | 155-165 | 10 | × |
| COMPARATIVE EXAMPLE 24 | 15 | 140-180 | 40 | × | 155-190 | 35 | △ | 160-190 | 30 | ○ |
| COMPARATIVE EXAMPLE 25 | 11 | 145-185 | 40 | × | 160-195 | 35 | △ | 165-195 | 30 | ○ |
| COMPARATIVE EXAMPLE 26 | 31 | 140-180 | 40 | × | 160-195 | 35 | △ | 165-195 | 30 | ○ |
| COMPARATIVE EXAMPLE 27 | 32 | 140-180 | 40 | × | 160-195 | 35 | △ | 165-195 | 30 | ○ |

○ : WINDING OF PRINTING SHEET AROUND HEAT ROLLER IS NOT OBSERVED, AND WRINKLE OF PRINTING SHEET IS NOT OBSERVED
△ : WINDING OF PRINTING SHEET AROUND HEAT ROLLER IS NOT OBSERVED, BUT WRINKLE OF PRINTING SHEET IS OBSERVED
× : WINDING OF PRINTING SHEET AROUND HEAT ROLLER IS OBSERVED (PRINTING SHEET IS NOT EJECTED)

DEVELOPER, IMAGE FORMING METHOD AND IMAGE FORMING APPARATUS

BACKGROUND OF THE INVENTION

This invention relates to a developer (for example, a toner) used for developing a latent image in an electrophotographic apparatus. This invention also relates to an image forming apparatus and an image forming method using the developer.

A toner used in the electrophotographic apparatus is required to have a property of preventing an offset. The offset is divided broadly into a hot offset and a cold offset. The cold offset is a phenomena that the toner melts (where the toner contacts a heat roller) and sticks to the surface of the heat roller. The hot offset is a phenomena that the temperature of the molten toner becomes excessively high, and the cohesive power of the toner is reduced, so that the toner sticks to the heat roller.

Recently, it is demanded to make it possible to touch-up a full color image that has been printed by the electrophotographic apparatus. For this purpose, there has been developed a so-called oilless fixing device in which the small amount of oil (or no oil) is coated on the heat roller. In the case where the oilless fixing device is used, it is necessary to increase the elasticity of the toner at high temperature to thereby increase the cohesive power, in order to prevent a printing sheet from being wound around the heat roller. However, if the elasticity of the toner at high temperature is high, the cold offset may easily occur.

In order to solve these problems, it is proposed to use two kinds of waxes having different softening temperatures, as releasing agents contained in the toner. Such a toner is disclosed by, for example, Japanese Laid-Open Patent Publication No. 2003-91094.

In the case where a full color image (i.e., an image of high density) is printed on a printing medium having a large heat capacity such as a thick paper, a large heat energy is absorbed by the printing medium when the image is fixed to the printing medium, and therefore it is necessary to increase the fixing temperature or decrease the feeding speed of the printing medium (i.e., a circumferential speed of the heat roller). However, if the fixing temperature is increased, the temperature difference between respective portions of the heat roller increases, and therefore the temperature may partially be out of the temperature range in which the fixing can be favorably performed. In such a case, the degradation of the fixing quality may occur. Thus, in the conventional technology disclosed by the above described publication, the feeding speed (20 to 150 mm/s) during the printing of the full color image is set to be lower than the feeding speed (80 to 200 mm/s) during the printing of the monochrome image. Accordingly, in the conventional technology, it is not possible to print the full color image at high speed.

SUMMARY OF THE INVENTION

An object of the present invention is to provide a developer capable of printing a full color image at high speed.

The present invention provides a developer used for developing a latent image. The developer includes a releasing agent and a binder resin. A melting point Tw of the releasing agent is higher than or equals to a softening temperature Ts of the developer measured by a capillary rheometer of a constant shear stress type. The melting point Tw of the releasing agent is lower than or equals to a melting temperature Tm of the developer measured by ½ method.

The present invention also provides an image forming apparatus including a developing unit that develops the latent image using the above described developer to form a developer image, a transferring unit that transfers the developer image to a printing medium, and a fixing unit that feeds the printing medium at a speed higher than or equals to 150 mm/s and fixes the developer image to the printing medium.

The present invention also provides an image forming method including the steps of developing the latent image to form a developer image using the above described developer, transferring the developer image to a printing medium, and fixing the developer image to the printing medium while feeding the printing medium at a speed higher than or equals to 150 mm/s.

With such a developer, an image forming apparatus or an image forming method, the full color image can be printed at high speed.

BRIEF DESCRIPTION OF THE DRAWINGS

In the attached drawings:

FIG. 6 shows thermal properties, favorable fixing temperature ranges, and fixing margins of the toners of Examples 1 to 5 and Comparative Examples 1 to 5;

FIG. 7 shows the thermal properties, the favorable fixing temperature ranges, and the fixing margins of the toners of Examples 6 to 11 and Comparative Examples 6 to 9;

FIG. 8 shows the thermal properties, the favorable fixing temperature ranges, and the fixing margins of the toners of Examples 12 to 17 and Comparative Examples 10 to 13;

FIG. 9 shows the thermal properties of the toners of Examples 18 and 19 and Comparative Examples 14 to 21;

FIG. 10 shows the favorable fixing temperature ranges, and the fixing margins of the toners of Examples 18 and 19 and Comparative Examples 14 to 21;

FIG. 11 shows the favorable peel strength temperatures of the toners of Examples 18 and 19 and Comparative Examples 14 to 21;

FIG. 12 shows the thermal properties of the toners of Examples 20 to 25 and Comparative Examples 22 to 27; and FIG. 13 shows the favorable fixing temperature ranges and the fixing margins of the toners of Examples 20 to 25 and Comparative Examples 22 to 27 and moving conditions of the printing sheet bearing the toners.

DETAILED DESCRIPTION OF THE PREFERRED EMBODIMENT

Embodiments of the present invention will be described with reference to the attached drawings.

Prior to the description of a toner (i.e., a developer) of the present invention, an image forming apparatus using the toner will be described with reference to FIG. 1.

Figure 1:
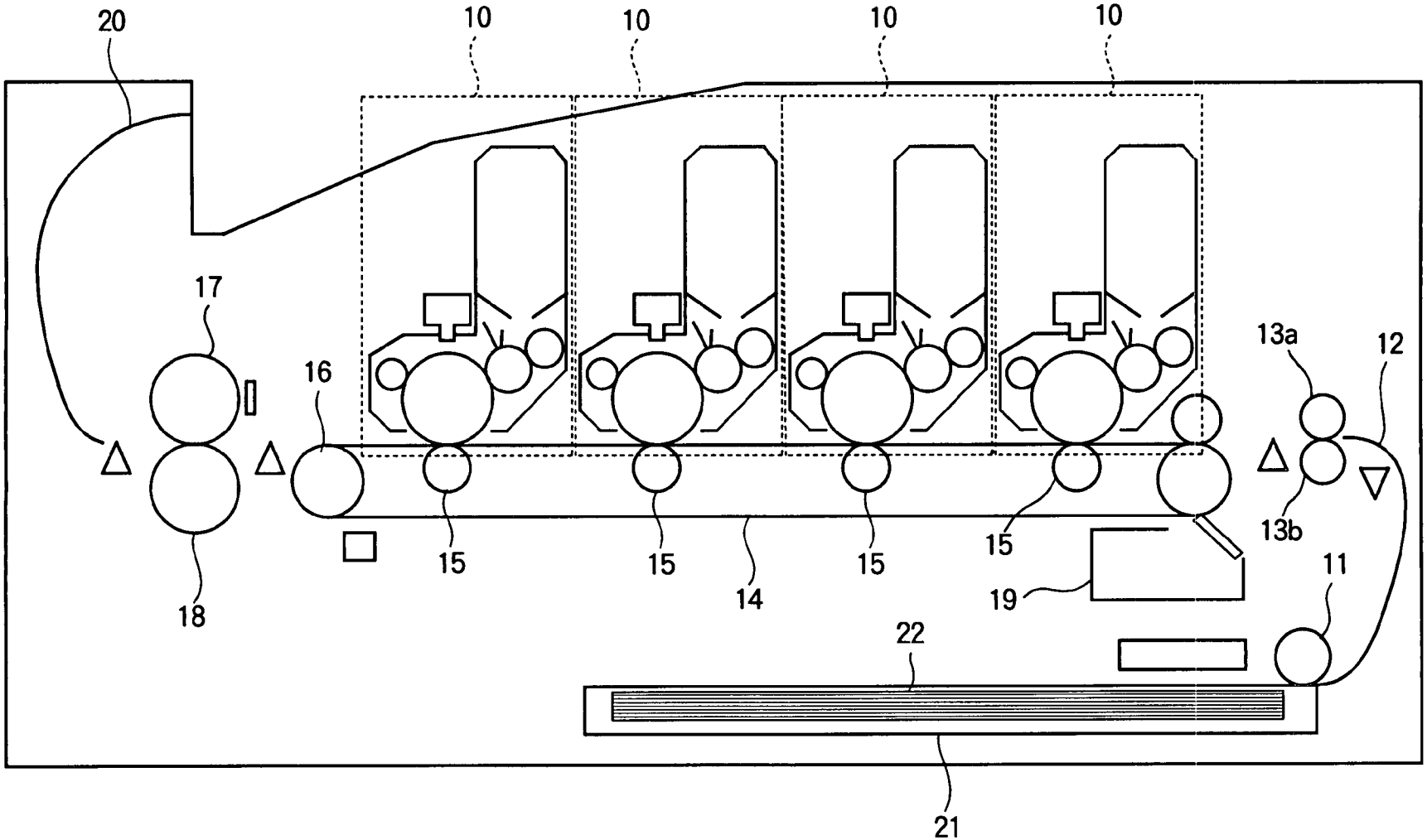
FIG. 1 is a side view showing a structure of an image forming apparatus using a developer (i.e., a toner) according to embodiments of the present invention.

As shown in FIG. 1, the image forming apparatus includes four developing devices 10, a sheet feeding roller 11, a sheet feeding guide 12, carrying rollers 13*a* and 13*b*, a transfer belt 14, four transfer rollers 15, a drive roller 16, a heat roller 17, a pressure roller 18, a belt cleaner 19, an eject guide 20 and a sheet cassette 21. Printing sheets 22 (i.e., printing media) are stacked in the cassette 21. The heat roller 17 and the pressure roller 18 constitute a fixing device.

Figure 2:
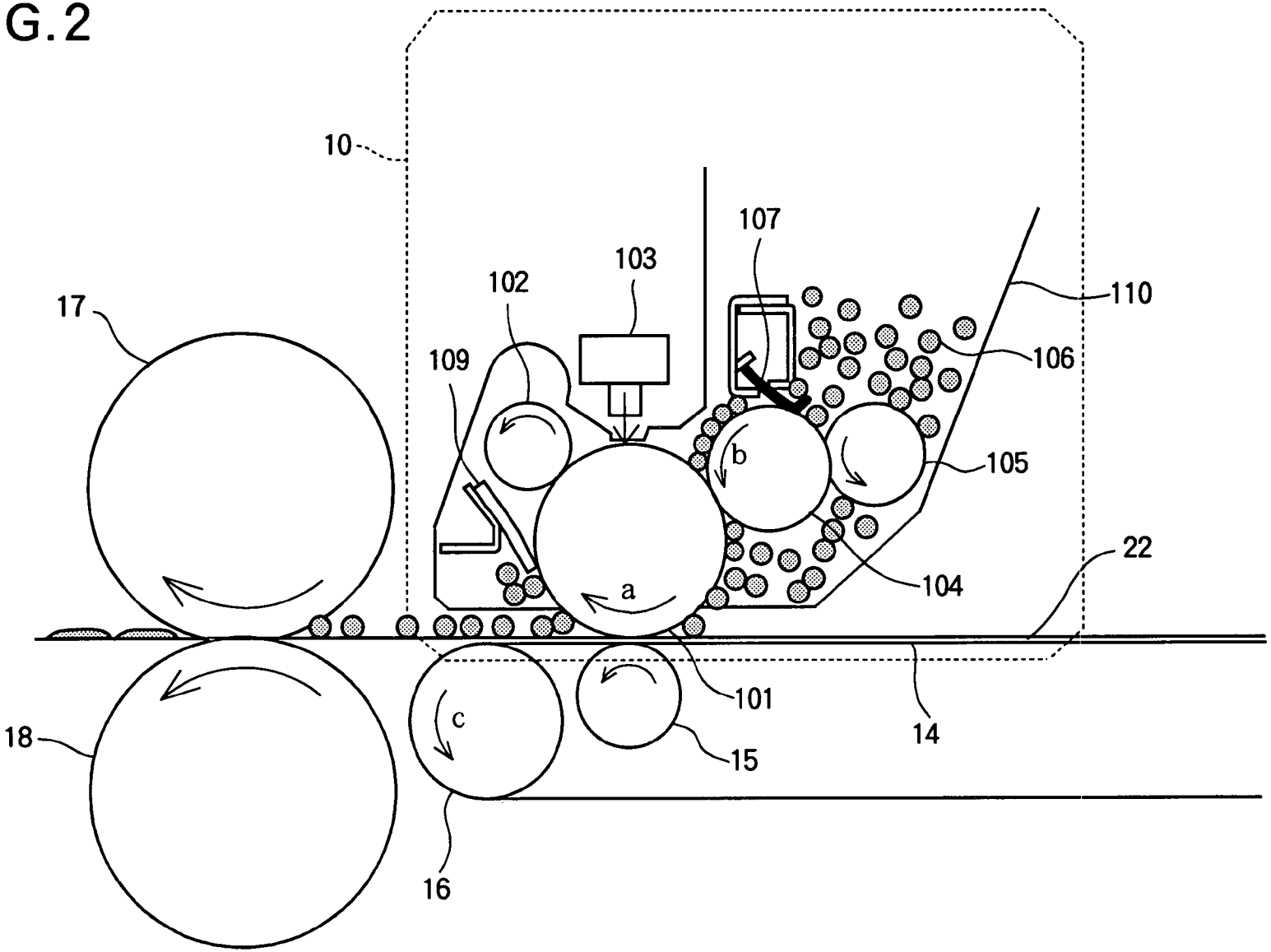
FIG. 2 is an enlarged view of a part including a developing device of the image forming apparatus shown in FIG. 1.

FIG. 2 shows a part including the developing device 10 located on the left end of the four developing devices 10 shown in FIG. 1. As shown in FIG. 2, the developing device 10 includes a photosensitive drum (i.e., an image bearing body) 101, a charging device (hereinafter referred to as a charging roller) 102, an exposing device 103, a developing roller 104, a toner supply roller 105, a developing blade 107, a cleaning blade 109 and a toner storing portion 110. The developing roller 104, the toner supply roller 105 and the developing blade 107 are disposed in the toner storing portion 110.

The photosensitive drum 101 includes a conductive support member and a photoconductive layer. The support member is constructed by a metal pipe made of aluminum. The photoconductive layer is made of an organic photosensitive body, and includes an electron generation layer formed on the metal pipe and an electron transport layer formed on the electron generation layer. The charging roller 102 is constructed by, for example, a metal shaft and a semiconductive rubber layer. The developing roller 104 is constructed by, for example, a metal shaft and a semiconductive urethane rubber.

The operation of the image forming apparatus will be described. In the image forming process, the photosensitive drum 101 is rotated by a not shown driving mechanism at a constant circumferential speed in a direction shown by an arrow "a" (clockwise in FIG. 2). The charging roller 102 contacts the surface of the photosensitive drum 101 and rotates counterclockwise. A direct high voltage is applied to the charging roller 102 by a not shown high voltage power source (for the charging roller 102), so that the charging roller 102 uniformly charges the surface of the photosensitive drum 101. The exposing device 103 is provided in opposition to the photosensitive drum 101, and irradiates the light to the surface of the photosensitive drum 101 according to the image information, so as to form a latent image on the surface of the photosensitive drum 101. An LED (Light Emitting Diode) unit can be used as the exposing device 103.

The toner supply roller 105 is disposed in the toner storing portion 110 in which the toner (denoted by numeral 106) is stored. A direct high voltage is applied to the toner supply roller 105 by a not shown high voltage power source (for the toner supply roller 105). The toner supply roller 105 rotates and supplies the toner 106 to the developing roller 104. The toner 106 adheres to the surface of the developing roller 104, and the developing roller 104 rotates counterclockwise as shown by an arrow "b" in FIG. 2. On the downstream side of a contact portion between the developing roller 104 and the toner supply roller 105, the developing blade 107 contacts the surface of the developing roller 104. The developing blade 107 forms a toner layer having a uniform thickness on the surface of the developing roller 104.

A bias voltage is applied between the conductive support of the photosensitive drum 101 and the developing roller 104 by a not shown high voltage power source (for the toner bearing body). Due to the bias voltage, lines of electrostatic force are generated between the developing roller 104 and the photosensitive drum 101 according to the latent image formed on the photosensitive drum 101. Due to the lines of electrostatic force, the toner on the developing roller 104 adheres to the latent image on the photosensitive drum 101, so as to form a toner image (i.e., a developer image).

The printing sheet 22 is fed out of the sheet cassette 21 shown in FIG. 1 and fed along the sheet feeding guide 12 to a nip portion between the carrying rollers 13*a* and 13*b* that have not yet started rotating. The carrying rollers 13*a* and 13*b* start rotating when a predetermined time has passed after the printing sheet 22 reaches the nip portion, so as to correct the skew of the printing sheet 22. After the skewing of the printing sheet 22 is corrected, the carrying rollers 13*a* and 13*b* continue to rotate, so that the printing sheet 22 (nipped by the carrying rollers 13*a* and 13*b*) reaches the transfer belt 14. The transfer belt 14 is rotated by the drive roller 16 counterclockwise, i.e., in the direction shown by an arrow c in FIG. 2. The toner image formed on the photosensitive drum 101 is transferred to the printing sheet 22 by means of the transfer roller 15 to which the direct high voltage is applied by a not shown high voltage power source (for the transfer roller 15).

The printing sheet 22 is carried to the fixing device including the heat roller 17 and the pressure roller 18. In the fixing device, the toner is molten by the heat of the heat roller 17, and the molten toner permeate into between fibers of the printing sheet 22, with the result that the toner is fixed to the printing sheet 22. The printing sheet 22 to which the toner image is fixed is carried along the eject guide 20, and ejected out of the image forming apparatus. The toner that remains on the surface of the photosensitive drum 101 after the transferring process is removed by the cleaning blade 109 that contacts the surface of the photosensitive drum 101.

Next, the toner of the first to third embodiments will be described.

First Embodiment

First, the toner of the first embodiment will be described. The toner of the first embodiment includes, at least, a binder resin, a releasing agent, a coloring agent, and a fluidizing agent. The melting point Tw of the releasing agent, the softening temperature Ts of the toner, and the melting temperature Tm of the toner measured by ½ method (described later) satisfy the relationship: $Ts \leqq Tw \leqq Tm$. Hereinafter, Examples of the toner of the first embodiment and Comparative Examples will be described.

EXAMPLE 1

The toner (hereinafter, referred to as toner 1) of Example 1 includes:

a binder resin (polyester resin whose number-average molecular weight Mn is 3700 and whose glass-transition temperature Tg is 62° C.) of 100 weight parts;

a charge controlling agent (salicylacetate complex) of 1.0 weight parts;

a coloring agent (phthalocyanine blue: CI pigment blue 15:3) of 3.0 weight parts, and a releasing agent of 10.0 weight parts.

The above described compositions are sufficiently agitated and mixed in a mixing machine ("Henschel mixer" manufactured by Mitsui Miike Kakouki Co., Ltd.). The resultant material is kneaded by a continuous kneader of an open roller type ("Kneadex" manufactured by Mitsui Mining Co., Ltd.) at the temperature of 100° C. for approximately 3 hours. After the kneading, the resultant material is cooled to a room temperature. The resultant material is crushed by a crusher with an impact plate ("Dispersion Separator" manufactured by Nippon Pneumatic Manufacturing Co., Ltd.) using jet stream. Then, the resultant material is classified by a wheel air-stream classifier of a dry type ("Micron separator" manufactured by Hosokawa Micron Co., Ltd.) using a centrifugal force. As a result, the base toner whose mean volume diameter is 8.0 μm is obtained.

Then, the following silica is mixed with the base toner using the above described Henschel mixer at the rotation speed of 1000 rpm for 90 seconds, so that the following external additive (i.e., a fluidizing agent) is added to the surface of the base toner:

an external additive ("Silica R972" manufactured by Nippon Aerosil Co., Ltd) of 2.0 weight parts.

As a result, the toner 1 is obtained.

The releasing agent used in the toner 1 is referred to as a wax 1, and the melting point of the wax 1 is referred to as Tw1. The endothermic property is measured by a differential scanning calorimeter ("DSC 210" manufactured by Seiko Electric Industry Co., Ltd.) at the rate of temperature increase of 10° C./min. Based on the measurement result, the temperature at the peak of the endothermic property (i.e., the melting point Tw1 of the wax 1) is determined to be 100° C. (Tw1=100° C.).

Figure 3:
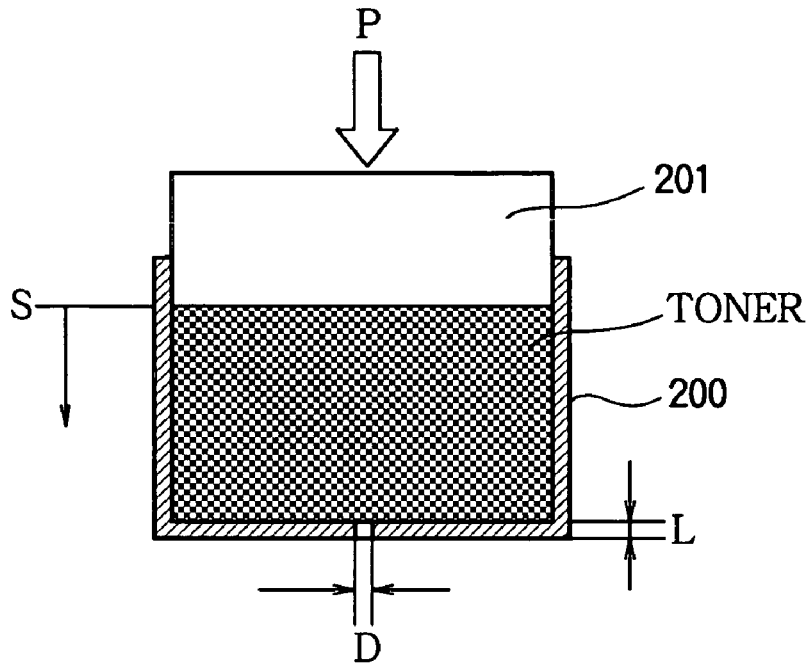
FIG. 3 shows a measuring device for measuring the thermal property of the toner.

As shown in FIG. 3, the thermal property of the toner 1 is measured by a flow tester, i.e., a capillary rheometer of a constant shear stress type ("CFT-500" manufactured by Shimadzu Corporation). In the measurement, the toner of 1 g is stored in a cylindrical case 200 with the inner diameter of 10 mm. A die with the inner diameter (D) of 1 mm and the length (L) of 1 mm is formed on the bottom of the cylindrical case 200. A load (P) of 20 Kg is applied to the toner by means of a piston 201. The displacement of the position (S) of the piston 201 is measured while the temperature increases at the rate of 6° C./min. The position (S) of the piston 201 when the temperature starts increasing is defined to be zero.

Figure 4:
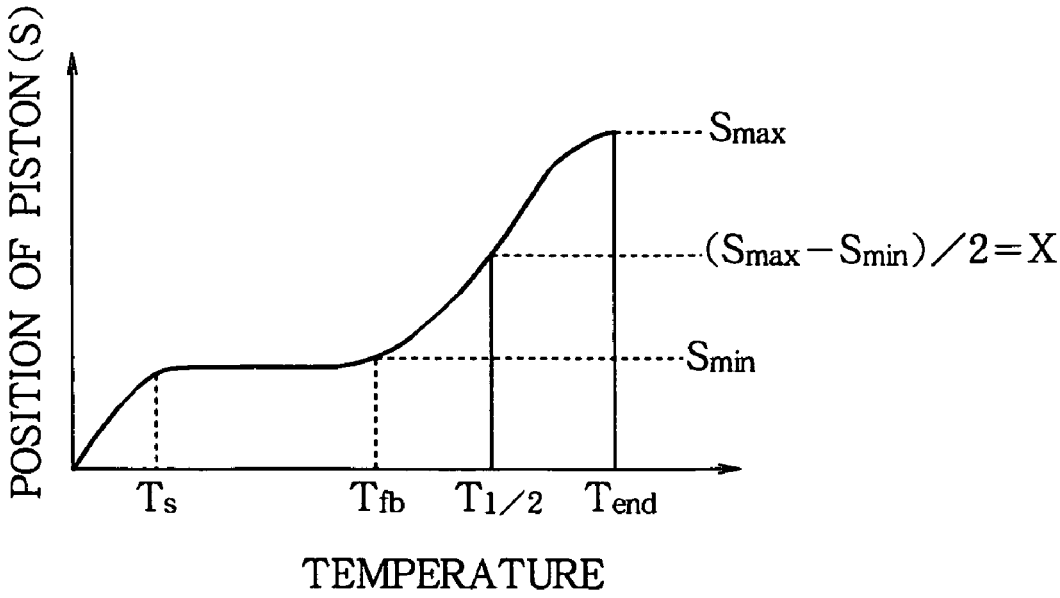
FIG. 4 is a graph showing the thermal property of the toner measured by the measuring device shown in FIG. 3.
Figure 5:
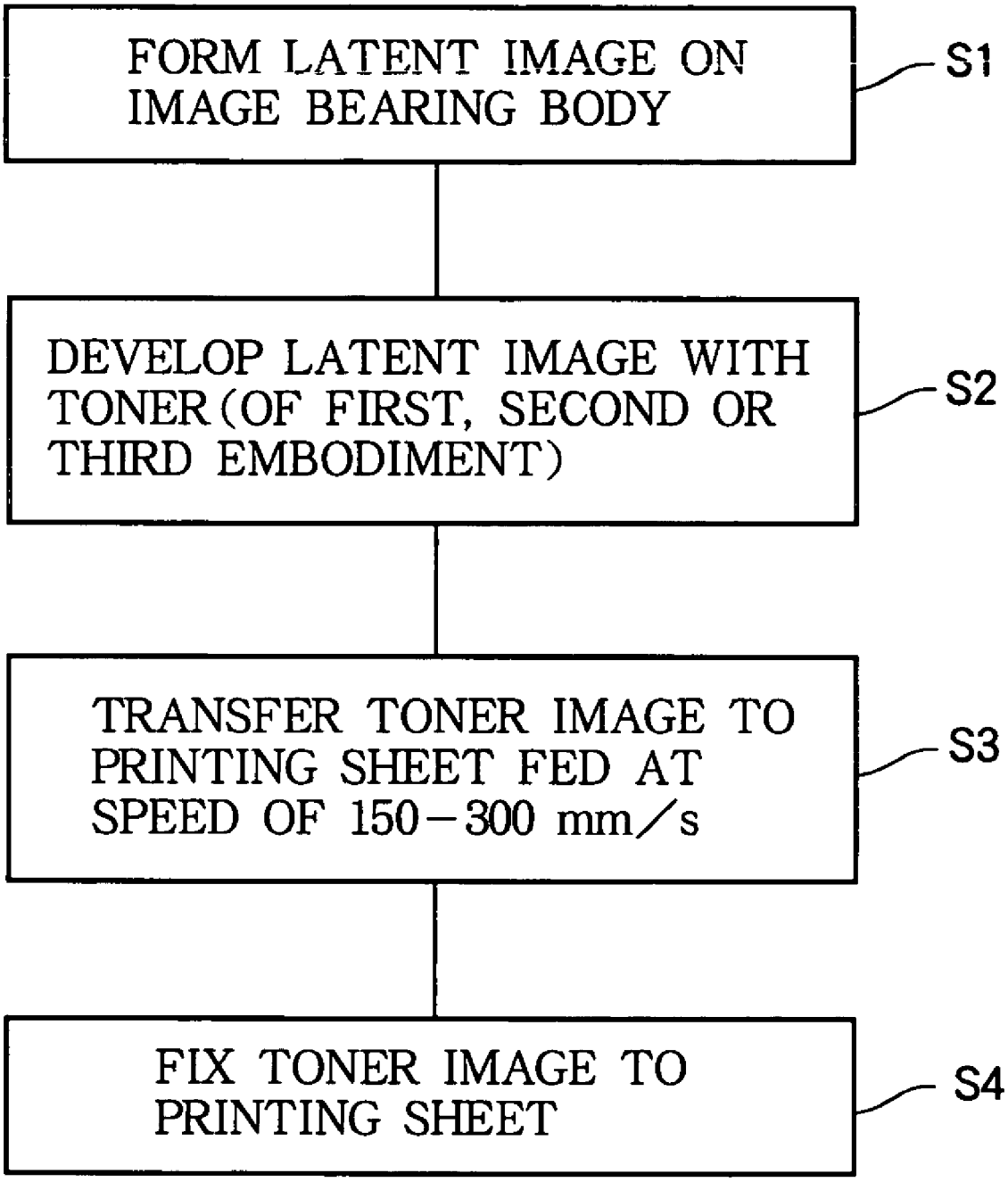
FIG. 5 is a flow chart illustrating an image forming method according to the embodiments of the present invention.

FIG. 4 is a graph showing the result of the measurement. The horizontal axis of the graph indicates the temperature, and the vertical axis of the graph indicates the position (S) of the piston 201. In FIG. 4, the temperature $T_S$ is referred to as a softening temperature, i.e., a temperature at which the internal cavities between the toners disappear and the toners externally become a single layer although the nonuniform stress distribution remains in the toners. The temperature $T_{fb}$ is referred to as a flow starting temperature, i.e., a temperature at which the piston 201 starts moving downward after the piston 201 slightly moves upward due to the thermal expansion of the toners. Hereinafter, the temperature $T_{fb}$ is simply indicated by Tf. The temperature $T_{end}$ is referred to as a flow ending temperature, i.e., a temperature at which all of the toners in the cylindrical case 200 flows out thereof.

The temperature $T_{1/2}$ is the melting temperature measured by the ½ method, i.e., a temperature at which half of the toner in the cylindrical case 200 flows out thereof. The position of the piston 201 at the melting temperature $T_{1/2}$ is expressed as:

$$S_{min}+(S_{max}-S_{min})/2$$

where $S_{min}$ is the position of the piston 201 at the flow starting temperature Tf, and $S_{max}$ is the position of the piston 201 at the flow ending temperature $T_{end}$. Hereinafter, the temperature $T_{1/2}$ is simply indicated by Tm.

The softening temperature Ts, the flow starting temperature Tf and the melting temperature Tm of the toner 1 are respectively indicated by $T_{s1}$, $T_{f1}$ and $T_{m1}$. Based on the measurement result, the temperatures $T_{s1}$, $T_{f1}$ and $T_{m1}$ are 88.6° C., 95.5° C. and 125.1° C.

Next, the temperature range of the heat roller 17 in which the toner 1 can be favorably fixed on the printing sheet (hereinafter, referred to as a favorable fixing temperature range) is measured. In the measurement, the image forming apparatus shown in FIG. 1 is used. The image forming apparatus is so arranged that the voltage applied to the developing roller 104, the voltage applied to the transfer roller 15, and the fixing temperature are variable.

The toner 1 is stored in the developing device 10. The printing sheet of A4 size ("J-sheet" manufactured by Fuji Xerox corporation) is used. The sheet feeding speed is set to 100 mm/s. The printing sheet is cross-fed so that two longer sides of the printing sheet respectively face the front and the rear in the feeding direction. The solid pattern (with the duty of 100%) is printed on the printing sheet. The high voltages for developing (i.e., the voltages applied to developing roller 104 and the supplying roller 105) are so set that the amount of the toner adhering to the surface of the printing sheet is 0.6 mg/cm$^2$. The amount of the toner adhering to the printing sheet can be determined by subtracting the weight of the printing sheet before the toner is transferred thereto from the weight of the printing sheet bearing the toner after the toner is transferred thereto, and by dividing the obtained weight by the area of the printing sheet. Whether there is a failure of the fixing of the solid pattern on the printing sheet or not is checked with naked eyes. The failure of the fixing may caused by a cold offset, a hot offset, a winding jam or the like. The cold offset is a phenomena that the surface temperature of the heat roller 17 is so low that the toner does not adhere to the printing sheet but adheres to the surface of the heat roller 17, with the result that the toner layer on the printing sheet becomes nonuniform. The hot offset is a phenomena that the surface temperature of the heat roller 17 is so high that the internal cohesive force of the toner becomes weak, and therefore the toner on the printing sheet adheres to the surface of the heat roller 17, with the result that the toner layer on the printing sheet becomes nonuniform. The winding jam is a phenomena that the toner does not well separate from the surface of the heat roller 17, and the toner is wound around the heat roller 17 together with the printing sheet, with the result that the printing sheet is not correctly ejected.

When the printing operation is performed under the condition that the surface temperature of the heat roller 17 is set to 135° C., the separation of the toner from the printing sheet (i.e., the cold offset) is observed. When the printing operation is performed under the condition that the surface temperature of the heat roller 17 is set to 140° C., the toner does not separate from the printing sheet, i.e., the cold offset is not observed. Similarly, the printing operations are performed under the condition that the surface temperature of the heat roller 17 is raised from 140° C. in steps of 5° C. As a result, it is confirmed that the failure of the fixing does not occur when the surface temperature of the heat roller 17 is from 140 to 180° C. Conversely, when the printing operation is performed under the condition that the surface temperature of the heat roller 17 is set to 185° C., the hot offset is observed. As a result, the favorable fixing temperature range (i.e., the temperature range of the heat roller 17 in which the toner 1 is favorably fixed to the printing sheet) is from 140° C. to 180° C. Thus, it is understood that the width of the favorable fixing temperature range (i.e., a fixing margin) is 40° C. (=180° C.-140° C.).

Next, the favorable fixing temperature range and the fixing margin are determined under the condition that the feeding speed of the printing sheet is changed to 150 mm/s and the amount of the toner adhering to the printing sheet is kept to 0.60 mg/cm$^2$. As a result, as shown in FIG. 6, the favorable fixing temperature range is from 155° C. to 190° C. Thus, it is understood that the fixing margin, i.e., the width of the favorable fixing temperature range is 35° C. (=190° C.-155° C.).

Next, the favorable fixing temperature range and the fixing margin are determined under the condition that the feeding speed of the printing sheet is changed to 300 mm/s and the amount of the toner adhering to the printing sheet is kept to 0.60 mg/cm$^2$. As a result, as shown in FIG. 6, the favorable fixing temperature range is from 160° C. to 190° C. Thus, it is understood that the width of the favorable fixing temperature range (the fixing margin) is 30° C. (=190° C.-160° C.).

EXAMPLES 2-5

A toner 2 of Example 2 is manufactured by replacing the wax 1 of the toner 1 with a wax 2 (whose melting point Tw2 is 110° C.) as the releasing agent. The other manufacturing condition of the toner 2 is the same as that of the toner 1.

A toner 3 of Example 3 is manufactured by replacing the wax 1 of the toner 1 with a wax 3 (whose melting point Tw3 is 120° C.) as the releasing agent. The other manufacturing condition of the toner 3 is the same as that of the toner 1.

A toner 4 of Example 2 is manufactured by replacing the wax 1 of the toner 1 with a wax 4 (whose melting point Tw4 is 89° C.) as the releasing agent. The other manufacturing condition of the toner 4 is the same as that of the toner 1.

A toner 5 of Example 5 is manufactured by replacing the wax 1 of the toner 1 with a wax 5 (whose melting point Tw5 is 94° C.) as the releasing agent. The other manufacturing condition of the toner 5 is the same as that of the toner 1.

Using the above described toners 2 through 5, the favorable fixing temperature ranges and the fixing margins are determined as was described in Example 1. The experimental result is shown in FIG. 6.

COMPARATIVE EXAMPLES 1

A toner 2 of Comparative Example 1 is manufactured by replacing the wax 1 (whose melting point Tw1 is 100° C.) of the toner 1 of Example 1 with a wax 6 (whose melting point Tw6 is 65° C.) as the releasing agent. The other manufacturing condition of the toner 6 is the same as that of the toner 1.

Using the above described toner 6, the favorable fixing temperature range and the fixing margin are determined as was described in Example 1. The result is shown in FIG. 6. In Comparative Example 1, there is no favorable fixing temperature range, and the failure of the fixing is observed at any temperature.

COMPARATIVE EXAMPLES 2-5

A toner 7 of Comparative Example 2 is manufactured by replacing the wax 1 of the toner 1 with a wax 7 (whose melting point Tw7 is 75° C.) as the releasing agent. The other manufacturing condition of the toner 7 is the same as that of the toner 1.

A toner 8 of Comparative Example 3 is manufactured by replacing the wax 1 of the toner 1 with a wax 8 (whose melting point Tw8 is 83° C.) as the releasing agent. The other manufacturing condition of the toner 8 is the same as that of the toner 1.

A toner 9 of Comparative Example 4 is manufactured by replacing the wax 1 of the toner 1 with a wax 9 (whose melting point Tw9 is 85° C.) as the releasing agent. The other manufacturing condition of the toner 9 is the same as that of the toner 1.

A toner 10 of Comparative Example 5 is manufactured by replacing the wax 1 of the toner 1 with a wax 10 (whose melting point Tw10 is 130° C.) as the releasing agent. The other manufacturing condition of the toner 10 is the same as that of the toner 1.

Using the above described toners 7 through 10, the favorable fixing temperature range and the fixing margin are determined as was described in Example 1. The result is shown in FIG. 6.

The summary of the above described toners 1-10 is as follows:

| Toner No. | Example No. | Comparative Example No. | Releasing Agent (Wax No.) |
|---|---|---|---|
| 1 | 1 | — | 1 |
| 2 | 2 | — | 2 |
| 3 | 3 | — | 3 |
| 4 | 4 | — | 4 |
| 5 | 5 | — | 5 |
| 6 | — | 1 | 6 |
| 7 | — | 2 | 7 |
| 8 | — | 3 | 8 |
| 9 | — | 4 | 9 |
| 10 | — | 5 | 10 |

According to FIG. 6, it is understood that a sufficiently wide fixing margin can be obtained for both sheet feeding speeds of 150 mm/s and 300 mm/s, when the melting point Tw of the wax (i.e., the releasing agent) is between the softening temperature Ts and the melting temperature Tm of the toner (Examples 1 to 5). Further, it is understood that the fixing margin becomes wider when the melting point Tw of the wax is between the flow starting temperature Tf and the melting temperature Tm of the toner (Examples 1 to 3).

EXAMPLES 6-11 AND COMPARATIVE EXAMPLES 6-9

A toner 15 of Example 6 is manufactured by replacing the wax 1 of the toner 1 with the above described wax 5 as the releasing agent, and by replacing the binder resin (whose number-average molecular weight Mn is 3700) of the toner 1 with a binder resin whose number-average molecular weight Mn is 2800. The other manufacturing condition of the toner 15 is the same as that of the toner 1.

A toner 11 of Example 7 is manufactured by replacing the binder resin of the toner 1 with the binder resin whose number-average molecular weight Mn is 2800. The other manufacturing condition of the toner 11 is the same as that of the toner 1.

A toner 17 of Example 8 is manufactured by replacing the wax 1 of the toner 1 with the above described wax 7 as the releasing agent, and by replacing the binder resin of the toner 1 with the binder resin whose number-average molecular weight Mn is 2800. The other manufacturing condition of the toner 17 is the same as that of the toner 1.

A toner 18 of Example 9 is manufactured by replacing the wax 1 of the toner 1 with the above described wax 8 as the releasing agent, and by replacing the binder resin of the toner 1 with the binder resin whose number-average molecular weight Mn is 2800. The other manufacturing condition of the toner 18 is the same as that of the toner 1.

A toner 19 of Example 10 is manufactured by replacing the wax 1 of the toner 1 with the above described wax 9 as the releasing agent, and by replacing the binder resin of the toner 1 with the binder resin whose number-average molecular weight Mn is 2800. The other manufacturing condition of the toner 19 is the same as that of the toner 1.

A toner 14 of Example 11 is manufactured by replacing the wax 1 of the toner 1 with the above described wax 4 as the releasing agent, and by replacing the binder resin of the toner 1 with the binder resin whose number-average molecular weight Mn is 2800. The other manufacturing condition of the toner 14 is the same as that of the toner 1.

A toner 16 of Comparative Example 6 is manufactured by replacing the wax 1 of the toner 1 with the above described wax 6 as the releasing agent, and by replacing the binder resin of the toner 1 with the binder resin whose number-average molecular weight Mn is 2800. The other manufacturing condition of the toner 16 is the same as that of the toner 1.

A toner 12 of Comparative Example 7 is manufactured by replacing the wax 1 of the toner 1 with the above described wax 2 as the releasing agent, and by replacing the binder resin of the toner 1 with the binder resin whose number-average molecular weight Mn is 2800. The other manufacturing condition of the toner 12 is the same as that of the toner 1.

A toner 13 of Comparative Example 8 is manufactured by replacing the wax 1 of the toner 1 with the above described wax 3 as the releasing agent, and by replacing the binder resin of the toner 1 with the binder resin whose number-average molecular weight Mn is 2800. The other manufacturing condition of the toner 13 is the same as that of the toner 1.

A toner 20 of Comparative Example 9 is manufactured by replacing the wax 1 of the toner 1 with the above described wax 10 as the releasing agent, and by replacing the binder resin of the toner 1 with the binder resin whose number-average molecular weight Mn is 2800. The other manufacturing condition of the toner 20 is the same as that of the toner 1.

The summary of the above described toners 11-20 is as follows:

| Toner No. | Example No. | Comparative Example No. | Mn of Binder Resin | Releasing Agent (Wax No.) |
|---|---|---|---|---|
| 11 | 7 | — | 2800 | 1 |
| 12 | — | 7 | 2800 | 2 |
| 13 | — | 8 | 2800 | 3 |
| 14 | 11 | — | 2800 | 4 |
| 15 | 6 | — | 2800 | 5 |
| 16 | — | 6 | 2800 | 6 |
| 17 | 8 | — | 2800 | 7 |
| 18 | 9 | — | 2800 | 8 |
| 19 | 10 | — | 2800 | 9 |
| 20 | — | 9 | 2800 | 10 |

Using the above described toners 11 through 20, the favorable fixing temperature range and the fixing margin are determined as was described in Example 1. The result is shown in FIG. 7.

According to FIG. 7, it is understood that a sufficiently wide fixing margin can be obtained for both sheet feeding speeds of 150 mm/s and 300 mm/s, when the melting point Tw of the wax is between the softening temperature Ts and the melting temperature Tm of the toner (Examples 6 through 11), even in the case where the number-average molecular weight of the binder resin is small (i.e., the softening temperature Ts, the flow starting temperature Tf and the melting temperature Tm are low). Further, it is understood that the fixing margin becomes wider when the melting point Tw of the toner is between the flow starting temperature Tf and the melting temperature Tm (Examples 6 and 7).

EXAMPLES 12-17 AND COMPARATIVE EXAMPLES 10-13

A toner 25 of Example 12 is manufactured by replacing the wax 1 of the toner 1 with the above described wax 5 as the releasing agent, reducing the amount of the wax to 3.0 weight parts (from 10.0 weight parts), and replacing the binder resin (whose number-average molecular weight Mn is 3700) of the toner 1 with the binder resin whose number-average molecular weight Mn is 2800. The other manufacturing condition of the toner 25 is the same as that of the toner 1.

A toner 21 of Example 13 is manufactured by reducing the amount of the wax 1 of the toner 1 of Example 1 to 3.0 weight parts, and replacing the binder resin of the toner 1 with the binder resin whose number-average molecular weight Mn is 2800. The other manufacturing condition of the toner 21 is the same as that of the toner 1.

A toner 27 of Example 14 is manufactured by replacing the wax 1 of the toner 1 with the above described wax 7 as the releasing agent, reducing the amount of the wax to 3.0 weight parts, and replacing the binder resin of the toner 1 with the binder resin whose number-average molecular weight Mn is 2800. The other manufacturing condition of the toner 27 is the same as that of the toner 1.

A toner 28 of Example 15 is manufactured by replacing the wax 1 of the toner 1 with the above described wax 8 as the releasing agent, reducing the amount of the wax to 3.0 weight parts, and replacing the binder resin of the toner 1 with the binder resin whose number-average molecular weight Mn is 2800. The other manufacturing condition of the toner 28 is the same as that of the toner 1.

A toner 29 of Example 16 is manufactured by replacing the wax 1 of the toner 1 with the above described wax 9 as the releasing agent, reducing the amount of the wax to 3.0 weight parts, and replacing the binder-resin of the toner 1 with the binder resin whose number-average molecular weight Mn is 2800. The other manufacturing condition of the toner 29 is the same as that of the toner 1.

A toner 24 of Example 17 is manufactured by replacing the wax 1 of the toner 1 with the above described wax 4 as the releasing agent, reducing the amount of the wax to 3.0 weight parts, and replacing the binder resin of the toner 1 with the binder resin whose number-average molecular weight Mn is 2800. The other manufacturing condition of the toner 24 is the same as that of the toner 1.

A toner 26 of Comparative Example 10 is manufactured by replacing the wax 1 of the toner 1 with the above described wax 6 as the releasing agent, reducing the amount of the wax to 3.0 weight parts, and replacing the binder resin of the toner 1 with the binder resin whose number-average molecular weight Mn is 2800. The other manufacturing condition of the toner 26 is the same as that of the toner 1.

A toner 22 of Comparative Example 11 is manufactured by replacing the wax 1 of the toner 1 with the above described wax 2 as the releasing agent, reducing the amount of the wax to 3.0 weight parts, and replacing the binder resin of the toner 1 with the binder resin whose number-average molecular weight Mn is 2800. The other manufacturing condition of the toner 22 is the same as that of the toner 1.

A toner 23 of Comparative Example 12 is manufactured by replacing the wax 1 of the toner 1 with the above described wax 3 as the releasing agent, reducing the amount of the wax to 3.0 weight parts, and replacing the binder resin of the toner 1 with the binder resin whose number-average molecular weight Mn is 2800. The other manufacturing condition of the toner 23 is the same as that of the toner 1.

A toner 30 of Comparative Example 13 is manufactured by replacing the wax 1 of the toner 1 with the above described wax 10 as the releasing agent, reducing the amount of the wax to 3.0 weight parts, and replacing the binder resin of the toner 1 with the binder resin whose number-average molecular weight Mn is 2800. The other manufacturing condition of the toner 30 is the same as that of the toner 1.

The summary of the above described toners 21-30 are as follows:

| Toner No. | Example No. | Comparative Example No. | Mn of Binder Resin | Releasing Agent (Wax No.) | Wax Weight Parts |
|---|---|---|---|---|---|
| 21 | 13 | — | 2800 | 1 | 3 |
| 22 | — | 11 | 2800 | 2 | 3 |
| 23 | — | 12 | 2800 | 3 | 3 |
| 24 | 17 | — | 2800 | 4 | 3 |
| 25 | 12 | — | 2800 | 5 | 3 |
| 26 | — | 10 | 2800 | 6 | 3 |
| 27 | 14 | — | 2800 | 7 | 3 |
| 28 | 15 | — | 2800 | 8 | 3 |
| 29 | 16 | — | 2800 | 9 | 3 |
| 30 | — | 13 | 2800 | 10 | 3 |

Using the above described toners 21 through 30, the favorable fixing temperature range and the fixing margin are determined as was described in Example 1. The result is shown in FIG. 8.

According to FIG. 8, it is understood that a sufficiently wide fixing margin can be obtained for both sheet feeding speeds of 150 mm/s and 300 mm/s, when the melting point Tw of the wax is between the softening temperature Ts and the melting temperature Tm of the toner (Examples 12 through 17), even in the case where the amount of the releasing agent (wax) is reduced from 10.0 weight parts to 3.0 weight parts. Further, it is understood that the fixing margin becomes wider when the melting point Tw of the toner is between the flow starting temperature Tf and the melting temperature Tm of the toner (Examples 12 and 13).

It is known that the fixing margin becomes smaller as the sheet feeding speed becomes higher than 300 mm/s, although the experimental result thereof is not shown.

Based on FIGS. 6, 7 and 8, it is understood that a sufficiently wide fixing margin can be obtained for both sheet feeding speeds of 150 mm/s and 300 mm/s, when the melting point Tw of the wax is between the softening temperature Ts and the melting temperature Tm of the toner (i.e., $Ts \leqq Tw \leqq Tm$). Further, it is understood that the fixing margin becomes wider when the melting point Tw of the toner is between the flow starting temperature Tf of and the melting temperature Tm of the toner (i.e., $Tf \leqq Tw \leqq Tm$).

As a result, it is possible to print a full color image at a sheet feeding speed faster than or equals to 150 mm/s by using the toner of the first embodiment including, at least, the binder resin, the releasing agent, the coloring agent and the fluidizing agent, in which the melting point Tw of the releasing agent and the softening temperature Ts and the melting temperature Tm (measured by ½ method) of the toner satisfy the relationship of:

$$Ts \leqq Tw \leqq Tm.$$

Second Embodiment

The toner of the second embodiment will be described. The toner of the second embodiment includes, at least, a binder resin, first and second releasing agents, a coloring agent and a fluidizing agent. The melting point Tw1 of the first releasing agent, the melting point Tw2 of the second releasing agent, the softening temperature Ts, the flow starting temperature and the melting temperature Tm (measured by ½ method) of the toner satisfy the relationships of:

$$Ts \leqq Tw1 \leqq Tf, \text{ and}$$

$$Tf \leqq Tw2 \leqq Tm.$$

Hereinafter, Examples of the second embodiment and Comparative Examples will be described. In order to avoid confusion, Examples and Comparative examples of the second embodiment are assigned the consecutive numbers following Examples and Comparative Examples of the first embodiment.

EXAMPLE 18

The toner (hereinafter, referred to as toner 31) of Example 18 includes:

a binder resin (polyester resin whose number-average molecular weight Mn is 2800 and whose glass-transition temperature Tg is 62° C.) of 100 weight parts;

a charge controlling agent (salicylacetate complex) of 1.0 weight parts;

a coloring agent (phthalocyanine blue: CI pigment blue 15:3) of 3.0 weight parts;

a releasing agent A of 5.0 weight parts, and a releasing agent B of 5.0 weight parts.

The above described compositions are sufficiently agitated and mixed in the mixing machine ("Henschel mixer" manufactured by Mitsui Miike Kakouki Co., Ltd.). The resultant material is kneaded by the continuous kneader of the open roller type ("Kneadex" manufactured by Mitsui Mining Co., Ltd.) at the temperature of 100° C. for approximately 3 hours. After the kneading, the resultant material is cooled to a room temperature. The resultant material is crushed by the crusher with the impact plate ("Dispersion Separator" manufactured by Nippon Pneumatic Manufacturing Co., Ltd.) using jet stream. Then, the resultant material is classified by the wheel air-stream classifier of dry type ("Micron separator" manufactured by Hosokawa Micron Co., Ltd.) using a centrifugal force. As a result, the base toner whose mean volume diameter is 8.0 μm is obtained.

Then, the following silica is mixed with the base toner using the above described Henschel mixer at the rotation speed of 1000 rpm for 90 seconds, so that the following external additive is added to the surface of the base toner:

an external additive ("Silica R972" manufactured by Nippon Aerosil Co., Ltd) of 2.0 weight parts.

The above described wax 1 (used in the toner 1) is used as the releasing agent A. The above described wax 8 is used as the releasing agent B.

As a result, the toner 31 is obtained.

The thermal properties of the toner 31, i.e., the softening temperature Ts, the flow starting temperature Tf, the melting temperature Tm (measured by ½ method) of the toner 31 are measured. The experimental result is shown in FIG. 9. As shown in FIG. 9, the softening temperature Ts (Ts31) of the toner 31 is 72.2° C. The flow starting temperature Tf (Tf31) of the toner 31 is 90.5° C. The melting temperature Tm (Tm31) of the toner 31 is 103.5° C.

Using the toner 31, the favorable fixing temperature range and the fixing margin are measured as was described in Example 1. The experimental result is shown in FIG. 10. As shown in FIG. 10, when the sheet feeding speed is 100 mm/s, the favorable fixing temperature range is 140° C. to 180° C. and the fixing margin is 40° C. When the sheet feeding speed is 150 mm/s, the favorable fixing temperature range is 155° C. to 190° C. and the fixing margin is 35° C. When the sheet feeding speed is 300 mm/s, the favorable fixing temperature range is 160° C. to 190° C. and the fixing margin is 30° C.

Next, a peel strength (i.e., a fixing strength) i.e., an adhesive strength between the toner and the surface of the printing sheet is experimentally determined. In order to increase the printing speed and to reduce the electric power consumption, it is preferable to lower the fixing temperature (at which the toner is fixed to the printing sheet) as low as possible. The method for measuring the peel strength will be described below.

The printing sheet of A4 size is cross-fed so that two longer sides of the printing sheet respectively face the front and the rear in the feeding direction. The solid pattern (with the duty of 100%) is printed on the printing sheet. The density DI of the solid pattern is measured on a small area of 1 $cm^2$ located at the center portion of a lower longitudinal end of the solid pattern. The density DI is measured by "X-Rite 528" manufactured by X-Rite incorporated (Status-I, Illuminant D50, and Viewer Angle 2°). Next, a printed sheet (i.e., the printing sheet on which the image has been formed) is placed on a flat table in such a manner that the printed surface is directed upward. Further, an adhesive surface of an adhesive tape ("Scotch Tape" manufactured by Sumitomo 3M Ltd.) is lightly placed on the printed sheet so that the adhesive surface covers the above described small area, corresponding to the position on which the image density D1 is measured. Then, a round-shaped weight (that weighs 500 g) with the diameter of 50 mm moves backward and forward respectively once, along the upper surface of the adhesive tape at a speed of 30 mm/s, so as to adhere the adhesive tape to the printed surface. And then, the adhesive tape is peeled off from the printed surface of the printed sheet at the speed of 30 mm/s in the direction parallel to the surface of the printed sheet. After the adhesive tape is peeled off from the printed sheet, the image density D2 of the above described small area on the printed sheet is measured. A peel strength ratio is calculated by D2/D1×100%.

The peel strength ratios are measured using 50 printed sheets, and the average thereof is calculated. The temperature of the heat roller 17 when the average peel strength ratio is 80% is measured, which is defined as a favorable peel strength temperature.

FIG. 11 shows the favorable peel strength temperature with regard to the toner 31. As shown in FIG. 11, the favorable peel strength temperature is 140° C. when the sheet feeding speed is 100 mm/s, 150° C. when the sheet feeding speed is 150 mm/s, and 160° C. when the sheet feeding speed is 300 mm/s.

EXAMPLE 19

A toner 32 of Example 19 is manufactured by replacing the wax 1 of the toner 31 with the wax 5 as the releasing agent A, and replacing the wax 8 with the wax 4 as the releasing agent B. The other manufacturing condition of the toner 32 is the same as that of the toner 31 of Example 18. FIG. 9 shows the thermal property of the toner 32. FIG. 10 shows the favorable fixing temperature range and the fixing margin measured by the method described in Example 18. FIG. 11 shows the favorable peel strength temperature.

COMPARATIVE EXAMPLES 14 THROUGH 21

Toners 33 through 40 of comparative Examples 14 through 21 are manufactured by respectively changing the combination of the releasing agent A and the releasing agent B.

As shown in FIG. 9, the toner 33 of Comparative Example 14 uses the wax 10 as the releasing agent A, and uses the wax 3 as the releasing agent B. The toner 34 of Comparative Example 15 uses the wax 3 as the releasing agent A, and uses the wax 5 as the releasing agent B. The toner 35 of Comparative Example 16 uses the wax 2 as the releasing agent A, and uses the wax 8 as the releasing agent B. The toner 36 of Comparative Example 17 uses the wax 2 as the releasing agent A, and uses the wax 6 as the releasing agent B. The toner 37 of Comparative Example 18 uses the wax 1 as the releasing agent A, and uses the wax 5 as the releasing agent B. The toner 38 of Comparative Example 19 uses the wax 5 as the releasing agent A, and uses the wax 6 as the releasing agent B. The toner 39 of Comparative Example 20 uses the wax 8 as the releasing agent A, and uses the wax 7 as the releasing agent B. The toner 40 of Comparative Example 21 uses the wax 7 as the releasing agent A, and uses the wax 6 as the releasing agent B.

Using the toners 33 through 40, the favorable fixing temperature range, the fixing margin and the favorable peel strength temperature are measured. The experimental results are shown in FIGS. 10 and 11.

The summary of the above described toners 31-40 is as follows:

| Toner No. | Example No. | Comparative Example No. | Releasing Agent A (Wax No.) | Releasing Agent B (Wax No.) |
|---|---|---|---|---|
| 31 | 18 | — | 1 | 8 |
| 32 | 19 | — | 5 | 4 |
| 33 | — | 14 | 10 | 3 |
| 34 | — | 15 | 3 | 5 |
| 35 | — | 16 | 2 | 8 |
| 36 | — | 17 | 2 | 6 |
| 37 | — | 18 | 1 | 5 |
| 38 | — | 19 | 5 | 6 |
| 39 | — | 20 | 8 | 7 |
| 40 | — | 21 | 7 | 6 |

In the toners 31 and 32 of Examples 18 and 19, the melting point TwA of the releasing agent A is between the flow start temperature Tf and the melting temperature Tm of the toner (i.e., Tf≦TwA≦Tm), and the melting point TwB of the releasing agent B is between the softening temperature Ts and the flow starting temperature Tf of the toner (i.e., Ts≦TwB<Tf). Thus, it is understood that the fixing margin is sufficiently wide. Further, the favorable peel strength temperature is 140° C. when the sheet feeding speed is 100 mm/s, 150° C. when the sheet feeding speed is 150 mm/s, and 160° C. when the sheet feeding speed is 300 mm/s. Thus, it is understood that the favorable peel strength temperature is sufficiently low.

Conversely, in the toner 33 of Comparative Example 14, the melting points TwA and TwB of the releasing agents A and B are higher than or equals to the melting temperature Tm of the toner measured by the ½ method, and no favorable fixing temperature range is obtained for the sheet feeding speeds of 150 mm/s and 300 mm/s. In the case of the toner 39 of Comparative Example 20, both of the melting points TwA and TwB of the releasing agent A are between the softening temperature Ts and the flow starting temperature Tf of the toner, and no favorable fixing temperature range is obtained for the sheet feeding speeds of 150 mm/s and 300 mm/s. In the case of the toner 40 of Comparative Example 21, the melting point TwA of the releasing agent A is between the softening temperature Ts and the flow starting temperature Tf of the toner, and the melting point TwB of the releasing agent B is lower than the softening temperature Ts of the toner, with the result that no favorable fixing temperature range is obtained for the sheet feeding speeds of 150 mm/s and 300 mm/s.

In the case of the toner 38 of Comparative Example 19, the fixing margin is 10° C. for the sheet feeding speed of 300 mm/s. This fixing margin is insufficient when the surrounding condition and the condition of the printing sheet (i.e., the printing medium) are taken into consideration.

In the cases of the toners 34, 35, 36 and 37 of Comparative Examples 15, 16, 17 and 18, the favorable peel strength temperature is higher than or equals to 170° C. at the sheet feeding speed of 300 mm/s. This temperature range is too high because the temperature is preferably lower than or equals to 160° C. when the electric power consumption or the like is taken into consideration.

It is known that, in the case of the toners 31 and 32 of Examples 18 and 19, the favorable peel strength temperature is higher than 160° C. when the sheet feeding speed becomes higher than 300 mm/s, although the experimental result thereof is not shown.

Based on FIGS. 9, 10 and 11, it is understood that a sufficiently wide fixing margin can be obtained when the toner includes two kinds of releasing agents (waxes) having different melting points, one of which is between the flow starting temperature Tf and the melting temperature Tm of the toner (i.e., $Tf \leqq TwA \leqq Tm$), and the other of which is between the softening temperature Ts and the flow starting temperature Tf of the toner ($Ts \leqq TwB < Tf$).

As a result, it is possible to print a full color image at a sheet feeding speed faster than or equals to 150 mm/s by using the toner of the second embodiment including, at least, the binder resin, the first and second releasing agents, the coloring agent and the fluidizing agent, in which the melting points Tw1 (TwB) and Tw2 (TwA) of the first and second releasing agents, the softening temperature Ts, the flow starting temperature Tf and the melting temperature Tm (measured by ½ method) of the toner satisfy the relationships of:

$$Ts \leqq Tw1 < Tf, \text{ and}$$

$$Tf \leqq Tw2 \leqq Tm.$$

Third Embodiment

Next, the toner of the third embodiment will be described. The toner of the third embodiment includes, at least, a binder resin, first, second and third releasing agents, a coloring agent, and a fluidizing agent. The melting points Tw1, Tw2 and Tw3 of the first, second and third releasing agents, the softening temperature Ts, the flow starting temperature Tf, and the melting temperature Tm (measured by ½ method) of the toner satisfy the relationships of:

$$Ts \leqq Tw1 < Tf,$$

$$Tf \leqq Tw2 \leqq Tm, \text{ and}$$

$$Tm < Tw3.$$

Hereinafter, the examples and Comparative Examples will be described. In order to avoid confusion, the examples and Comparative Examples of the third embodiment are assigned the consecutive numbers following the Examples and Comparative Examples of the second embodiment.

EXAMPLE 20

The toner (hereinafter, referred to as toner 41) of Example 20 includes:

a binder resin (polyester resin whose number-average molecular weight Mn is 2800 and whose glass-transition temperature Tg is 62° C.) of 100 weight parts;

a charge controlling agent (salicylacetate complex) of 1.0 weight parts;

a coloring agent (phthalocyanine blue: CI pigment blue 15:3) of 3.0 weight parts, a releasing agent A of 4.0 weight parts, a releasing agent B of 4.0 weight parts, and a releasing agent C of 2.0 weight parts.

The above described compositions are sufficiently agitated and mixed in the mixing machine ("Henschel mixer" manufactured by Mitsui Miike Kakouki Co., Ltd.). The resultant material is kneaded by the continuous kneader of the open roller type ("Kneadex" manufactured by Mitsui Mining Co., Ltd.) at the temperature of 100° C. for approximately 3 hours. After the kneading, the resultant material is cooled to a room temperature. The resultant material is crushed by the crusher with the impact plate ("Dispersion Separator" manufactured by Nippon Pneumatic Manufacturing Co., Ltd.) using jet stream. Then, the resultant material is classified by the wheel air-stream classifier of dry type ("Micron separator" manufactured by Hosokawa Micron Co., Ltd.) using a centrifugal force. As a result, the base toner whose mean volume diameter is 8.0 μm is obtained.

Then, the following silica is mixed with the base toner using the above described Henschel mixer at the rotation speed of 1000 rpm for 90 seconds, so the following external additive is added to the surface of the base toner:

an external additive ("Silica R972" manufactured by Nippon Aerosil Co., Ltd) of 2.0 weight parts.

The above described wax 1 (used in the toner 1) is used as the releasing agent A. The above described wax 8 is used as the releasing agent B. The above described wax 10 is used as the releasing agent C.

As a result, the toner 41 is obtained.

The thermal properties of the toner 41, i.e., the softening temperature Ts, the flow starting temperature Tf, the melting temperature Tm (measured by ½ method) of the toner 41 are measured. The experimental result is shown in FIG. 12. As shown in FIG. 12, the softening temperature Ts (Ts41) of the toner 41 is 73.0° C. The flow starting temperature Tf (Tf41) of the toner 41 is 92.2° C. The melting temperature Tm (Tm41) of the toner 41 is 103.7° C. Further, the favorable fixing temperature range and the fixing margin are measured as was described in Example 1. The experimental result is shown in FIG. 13.

The surface temperature of the heat roller 17 of the fixing device is set to a higher temperature than the temperature thereof during the normal operation. In this state, the moving condition of the printing sheet passing through the fixing device is observed. The upper limit of the surface temperature of the heat roller 17 is set to 200° C., because it is known that the parts of the fixing device may suffer deformation or the like when the surface temperature of the heat roller 17 exceeds 200° C. As was described above, when the surface temperature of the heat roller 17 increases, the hot offset may occur. It is also known that, when the surface temperature of the heat roller 17 further increases, the toner on the printing sheet adheres to the heat roller 17, and the printing sheet may be wound around the surface of the heat roller 17, with the result that printing sheet may not be ejected out of the image forming apparatus (i.e., a failure of the image forming apparatus may occur). Therefore, it is desired that the printing sheet is not wound around the heat roller 17 even when the surface temperature of the heat roller 17 is sufficiently high (i.e., 200° C.).

On condition that the surface temperature of the heat roller 17 is set to 200° C., and the image is printed on the printing sheet using the toner 41, the moving condition of the printing sheet is observed. The experimental result is shown in FIG. 13. A shown in FIG. 13, even when the surface temperature of the heat roller 17 is 200° C., the winding of the printing sheet around the heat roller 17 is not observed, and the wrinkle of the ejected printing sheet is not observed for the sheet feeding speeds of 100 mm/s, 150 mm/s and 300 mm/s.

EXAMPLE 21

A toner 42 of Example 21 is manufactured by replacing the wax 1 of the toner 41 of Example 20 with the wax 5 as the releasing agent A, replacing the wax 8 of the toner 41 with the wax 4 as the releasing agent B, and replacing the wax 10 of the toner 41 with the wax 3 as the releasing agent C. The other manufacturing condition of the toner 42 is the same as that of the toner 41 of Example 20. The thermal properties of the toner 42 is shown in FIG. 12. The favorable fixing temperature range, the fixing margin and the moving condition of the printing sheet are shown in FIG. 13. As shown in FIG. 13, even when the surface temperature of the heat roller 17 is 200° C., the winding of the printing sheet around the heat roller 17 is not observed, and the wrinkle of the printing sheet is not observed for the sheet feeding speeds of 100 mm/s, 150 mm/s and 300 mm/s.

EXAMPLES 22-25

Toners 43 through 46 of Examples 22 through 25 are manufactured by respectively changing the combination of the releasing agent A and the releasing agent B of the toner 31 of Embodiment 18. The amount of the releasing agent A is 5.0 weight parts, and the amount of the releasing agent B is 5.0 weight parts. The other manufacturing condition of each of the toners 43 through 46 is the same as that of the toner 31 of Example 18. As shown in FIG. 12, the toner 43 of Example 22 uses the wax 9 as the releasing agent A, and uses the wax 2 as the releasing agent B. The toner 44 of Example 23 uses the wax 4 as the releasing agent A, and uses the wax 2 as the releasing agent B. The toner 45 of Example 24 uses the wax 5 as the releasing agent A, and uses the wax 3 as the releasing agent B. The toner 46 of Example 25 uses the wax 1 as the releasing agent A, and uses the wax 10 as the releasing agent B.

The summary of the above described toners 41-46 is as follows:

| Toner No. | Example No. | Releasing Agent A (Wax No.) | Releasing Agent B (Wax No.) | Releasing Agent C (Wax No.) |
|---|---|---|---|---|
| 41 | 20 | 1 | 8 | 10 |
| 42 | 21 | 5 | 4 | 3 |
| 43 | 22 | 9 | 2 | — |
| 44 | 23 | 4 | 2 | — |
| 45 | 24 | 5 | 3 | — |
| 46 | 25 | 1 | 10 | — |

The thermal properties of the toners 43 through 46 are shown in FIG. 12. The favorable fixing temperature range, the fixing margin and the moving condition of the printing sheet are shown in FIG. 13. As shown in FIG. 13, in the case of the toners 43 through 46, the winding of the printing sheet around the heat roller 17 is not observed, even when the surface temperature of the heat roller 17 is 200° C. However, the wrinkle of the ejected printing sheet is observed when the sheet feeding speed is 100 mm/s and 150 mm/s.

COMPARATIVE EXAMPLES 22 AND 23

The toner 19 of Example 10 is treated as Comparative Example 22. The toner 14 of Example 11 is treated as Comparative Example 23. Using the toners 19 and 14, the favorable fixing temperature range, the fixing margin and the moving condition of the printing sheet (when the surface temperature of the heat roller 17 is 200° C.) are measured. The experimental result is shown in FIG. 13. As shown in FIG. 13, in Comparative Examples 22 and 23, the winding of the printing sheet around the heat roller 17 is observed (i.e., and therefore the printing sheet is not ejected out of the image forming apparatus) for the sheet feeding speeds of 100 mm/s, 150 mm/s and 300 mm/s.

COMPARATIVE EXAMPLES 24-27

The toner 15 of Example 6 is treated as Comparative Example 24. The toner 11 of Example 7 is treated as Comparative Example 25. The toner 31 of Example 18 is treated as Comparative Example 26. The toner 32 of Example 19 is treated as Comparative Example 27. Using the toners 15, 11, 31 and 32, the favorable fixing temperature range, the fixing margin and the moving condition of the printing sheet (when the surface temperature of the heat roller 17 is 200° C.) are measured. The experimental result is shown in FIG. 13.

As shown in FIG. 13, in Comparative Examples 24 through 27, the winding of the printing sheet around the heat roller 17 is not observed when the sheet feeding speed is 300 mm/s, even when the surface temperature of the heat roller 17 is 200° C. However, the wrinkle is observed on the printing sheet when the sheet feeding speed is 150 mm/s. Further, the winding of the printing sheet around the heat roller 17 is observed (and therefore the printing sheet is not ejected out of the image forming apparatus) when the sheet feeding speed is 100 mm/s.

It is known that the fixing margin becomes smaller (and therefore the winding of the printing sheet around the heat roller may easily occur) as the sheet feeding speed exceeds 300 mm/s, although the experimental result thereof is not shown.

Based on FIGS. 12 and 13, it is understood that a sufficiently wide fixing margin can be obtained and the winding of the printing sheet around the heat roller 17 can be prevented when the toner includes three kinds of releasing agents (waxes), and when the melting point Tw1 of the first releasing agent is between the softening temperature Ts and the flow starting temperature Tf of the toner (i.e., $Ts \leqq Tw1 < Tf$), the melting point Tw2 of the second releasing agent is between the flow starting temperature Tf and the melting temperature Tm of the toner (i.e., $Tf \leqq Tw2 \leqq Tm$), and the third melting point Tw3 of the releasing agent is higher than the melting temperature Tm (i.e., $Tm < Tw3$).

As a result, it is possible to print a full color image at a sheet feeding speed faster than or equals to 150 mm/s by using the toner of the third embodiment including, at least, the binder resin, the first, second and third releasing agents, the coloring agent and the fluidizing agent, in which the melting points Tw1, Tw2 and Tw3 of the first, second and third releasing agents, the softening temperature Ts, the flow starting temperature Tf and the melting temperature Tm (measured by ½ method) of the toner satisfy the relationships of:

$$Ts \leqq Tw1 < Tf,$$

$$Tf \leqq Tw2 \leqq Tm, \text{ and}$$

$$Tm < Tw3.$$

The toners of the above described Examples are made of the colored fine particles (including the binder resin, the coloring agent and, if needed, the additional agent) and the inorganic fine particles added to the colored fine particles. It is possible to use various kinds of conventionally known resin as the binder resin. For example, a styrene resin, an acrylic resin, a styrene-acrylic resin, polyester resin or the like.

The releasing agent is used for enhancing a luster (gross) of the toner and for preventing the offset on the heat roller 17. The releasing agent can be made of, for example, ester wax, paraffin latex, Microcrystallen wax, polypropylene, polyethylene or the like. Each of these components can be used individually or in combination with each other. The adding amount of the releasing agent is preferably 1 wt % to 10 wt %.

As the coloring agent, it is possible to use conventionally known carbon black, CI pigment blue 15:3, CI pigment blue 15, CI pigment blue 15:6, CI pigment blue 68, 2,9-Dimethylquinacridone, CI pigment yellow 17, CI pigment yellow 81, CI pigment yellow 154, CI pigment yellow 185 or the like.

As the other additional agent, it is possible to use inorganic fine particles (whose number-average diameter of primary particle is from 5 nm to 1000 nm) such as silica, titanium oxide, aluminum oxide, barium titanate, strontium titanate or the like. These material can be hydrophobized.

Moreover, it is possible to add the cleaning assistant to the toner. The cleaning assistant is, for example, higher fatty acid metal salt such as zinc stearate or the like whose number-average diameter of primary particle is from 0.1 μm to 2.0 μm. Furthermore, the adding amount of the inorganic particles is preferably from 0.1 wt % to 3.0 wt % with respect to the colored particles. The adding amount of the cleaning assistant is preferably from 0.01 wt % to 1.0 wt % with respect to the colored particles.

Next, the image forming method of the embodiments of the present invention will be described. The image forming method includes a latent image forming step S1, a developing step S2, a transferring step S3, and a fixing step S4. In the latent image forming step S1, the latent image is formed on the photosensitive drum 101 (i.e., a latent image bearing body). In the developing step S2, the latent image is developed with the above described toner according to the first, second or third embodiment of the present invention. In the transferring step S3, the developed toner image is transferred to the printing sheet (i.e., the printing medium) fed at the predetermined speed ranging from 150 to 300 mm/s. In the fixing step S4, the toner image is fixed to the printing sheet. The toner of the above described Examples can be used in the developing step S2.

In the above described latent image forming step S1, the latent image is formed on the latent image bearing body including a photosensitive layer, a dielectric layer and the like, by means of an electrophotographic method or an electrostatic recording method. The photosensitive layer of the latent image bearing body can be made of a conventional material such as an organic photosensitive material, an amorphous silicon or the like. Further, the latent image bearing body (for example, the photosensitive drum) is made by a conventional manufacturing method including the steps of, for example, an extrusion forming of aluminum or aluminum alloy and a machining of the surface of the extruded body.

In the above described developing process, the toner is supplied by the toner supply roller 105 to the developing roller 104. The thin toner layer is formed on the developing roller 104 by means of the resilient blade (i.e., the developing blade 107) or the like, and is carried to the contact portion between the developing roller 104 and the photosensitive drum 101. By the bias voltage applied between the developing roller 104 and the photosensitive drum 101 on which the latent image is formed, the toner adheres to the latent image, so that the latent image is developed.

The above description is made to the image forming method of a tandem type using a plurality of developing devices 10 of respective colors each of which includes the photosensitive drum 101. The developer images are formed in the respective developing devices 10, and transferred to the printing medium on the transfer belt 14 by means of the transferring rollers 15 respectively provided corresponding to the developing devices 10. However, it is also possible to employ an image forming method of a transfer-drum type in which the printing medium is fixed to a transfer drum, and the developer images of respective colors are successively transferred from the photosensitive drum to the printing medium. It is also possible to employ an image forming method of an intermediate transfer belt type in which the developer image formed on the photosensitive drum is once transferred to an intermediate transfer belt, and then transferred to the printing medium. Further, it is also possible to employ an image forming method of an image-on-image developing type in which a plurality of developer images of respective colors are formed on the photosensitive drum and are simultaneously transferred to the printing medium.

The developing roller 104 used in the above described embodiment is a resilient roller including silicone rubber, urethane rubber or the like. It is possible to use the developing roller whose surface is processed by polishing, blasting or the like for enhancing the transport property and charging property of the toner. It is also possible to use the developing roller having the surface on which a coating is applied for enhancing the transport property and charging property of the toner. The formation of the toner layer on the developing roller is accomplished by the developing blade 107 contacting the developing roller 104. The developing blade 107 is made of a resilient material such as silicone rubber, urethane rubber, stainless steel or the like. It is possible to add and disperse organic or inorganic additive to the resilient material.

The above description is made to the image forming apparatus of a tandem type using a plurality of developing devices 10 of respective colors each of which includes the photosensitive drum 101. The developer images are formed in the respective developing devices 10, and transferred to the printing medium on the transfer belt 14 by means of the transferring rollers 15 respectively provided corresponding to the developing devices 10. However, it is also possible to employ an image forming apparatus of a transfer-drum type in which the printing medium is fixed to a transfer drum, and the developer images of respective colors are successively transferred from the photosensitive drum to the printing medium. It is also possible to employ an image forming apparatus of an intermediate transfer belt type in which the developer image formed on the photosensitive drum is once transferred to an intermediate transfer belt, and then transferred to the printing medium. Further, it is also possible to employ an image forming apparatus of image-on-image developing type in which a plurality of developer images of respective colors are formed on the photosensitive drum and simultaneously transferred to the printing medium.

It is possible to use a contact type transferring system in which the transfer roller is urged against the photosensitive drum, or a non-contact type transferring system using a corotron. In the above described fixing step, it is possible to use the fixing device of a heat fixing type having a heat roller.

Using the toner of the present invention, it becomes possible to print a full color image at a speed higher from 150 to 300 mm/s without causing the offset phenomena or sheet jam.

While the preferred embodiments of the present invention have been illustrated in detail, it should be apparent that modifications and improvements may be made to the invention without departing from the spirit and scope of the invention as described in the following claims.

What is claimed is:

1. An image forming apparatus, comprising:

a developer comprising a releasing agent and a binder resin;

a developing unit that develops a latent image to form a developer image using said developer;

a transferring unit that transfers said developer image to a printing medium; and a fixing unit that feeds said printing medium at a speed higher than or equal to 150 mm/s to fix said developer image to said printing medium;

wherein a melting point Tw of said releasing agent is higher than or equal to a softening temperature Ts of said developer measured by a capillary rheometer of a constant shear stress type;

wherein said melting point Tw of said releasing agent is lower than or equal to a melting temperature Tm of said developer measured by a ½ method;

wherein said releasing agent comprises a first releasing agent and a second releasing agent, and wherein melting points Tw1 and Tw2 of said first and second releasing agents, said softening temperature Ts, and said melting temperature Tm satisfy the following relationship:

$$Ts \leqq Tw1 < Tf$$

$$Tf \leqq Tw2 < Tm$$

where Tf is a temperature at which said developer starts flowing measured by said capillary rheometer of said constant shear stress type;

wherein the melting point Tw1 of the first releasing agent is higher than or equal to 83° C., and lower than or equal to 89° C.; and wherein the melting point Tw2 of the second releasing agent is higher than or equal to 94° C., and lower than or equal to 100° C.

2. The image forming apparatus according to claim 1, wherein substantially the same amount of said first releasing agent and said second releasing agent are contained.

3. An image forming apparatus, comprising:

a developer comprising a releasing agent and a binder resin;

a developing unit that develops a latent image to form a developer image using said developer;

a transferring unit that transfers said developer image to a printing medium; and a fixing unit that feeds said printing medium at a speed higher than or equal to 150 mm/s to fix said developer image to said printing medium;

wherein a melting point Tw of said releasing agent is higher than or equal to a softening temperature Ts of said developer measured by a capillary rheometer of a constant shear stress type;

wherein said melting point Tw of said releasing agent is lower than or equal to a melting temperature Tm of said developer measured by a ½ method;

wherein said releasing agent comprises a first releasing agent, a second releasing agent and a third releasing agent, and wherein melting points Tw1, Tw2 and Tw3 of said first, second and third releasing agents, said softening temperature Ts, and said melting temperature Tm satisfy the following relationship:

$$Ts \leqq Tw1 < Tf$$

$$Tf \leqq Tw2 < Tm$$

$$Tm > Tw3$$

where Tf is a temperature at which said developer starts flowing measured by said capillary rheometer of said constant shear stress type;

wherein the melting point Twi of the first releasing agent is higher than or equal to 83° C., and lower than or equal to 89° C.;

wherein the melting point Tw2 of the second releasing agent is higher than or equal to 94° C., and lower than or equal to 100° C.; and wherein the melting point Tw3 of the third releasing agent is higher than or equal to 120° C., and lower than or equal to 130° C.

4. The image forming apparatus according to claim 3, wherein said first, second and third releasing agents are contained in 2:2:1 ratio by weight.

5. The image forming apparatus according to claim 1, wherein a plurality of developing units are provided in accordance with a plurality of colors.

6. The image forming apparatus according to claim 1, wherein a plurality of transferring units are provided in accordance with a plurality of colors.

7. The image forming apparatus according to claim 1, wherein the transferring unit has a transferring member to which the developer image is transferred, and the developer image is further transferred from the transferring member to the printing medium.

8. The image forming apparatus according to claim 1, wherein the fixing unit feeds the printing medium at a speed lower than or equals to 300 mm/s.

9. The image forming apparatus according to claim 3, wherein a plurality of developing units are provided in accordance with a plurality of colors.

10. The image forming apparatus according to claim 3, wherein a plurality of transferring units are provided in accordance with a plurality of colors.

11. The image forming apparatus according to claim 3, wherein the transferring unit has a transferring member to which the developer image is transferred, and the developer image is further transferred from the transferring member to the printing medium.

12. The image forming apparatus according to claim 3, wherein the fixing unit feeds the printing medium at a speed lower than or equals to 300 mm/s.

* * * * *